US008028839B2

(12) United States Patent
Learn

(10) Patent No.: US 8,028,839 B2
(45) Date of Patent: Oct. 4, 2011

(54) SHIPPING AND DISPENSING CARTON

(75) Inventor: Angela E. Learn, Gilbertsville, PA (US)

(73) Assignee: Graphic Packaging International, Inc., Marietta, GA (US)

( * ) Notice: Subject to any disclaimer, the term of this patent is extended or adjusted under 35 U.S.C. 154(b) by 50 days.

(21) Appl. No.: 12/477,425

(22) Filed: Jun. 3, 2009

(65) Prior Publication Data

US 2009/0302098 A1 Dec. 10, 2009

Related U.S. Application Data

(60) Provisional application No. 61/059,136, filed on Jun. 5, 2008, provisional application No. 61/189,343, filed on Aug. 18, 2008.

(51) Int. Cl.
*B65D 5/50* (2006.01)

(52) U.S. Cl. ..... 206/774; 206/738; 206/756; 206/526; 229/235

(58) Field of Classification Search ..... 206/774, 206/45.24, 45.25, 756, 765, 738, 739, 192, 206/526; 229/235; 53/412
See application file for complete search history.

(56) References Cited

U.S. PATENT DOCUMENTS

| | | | | |
|---|---|---|---|---|
| 499,655 | A | 6/1893 | Clark | |
| 642,121 | A | 1/1900 | Hildreth | |
| 1,503,161 | A | 7/1924 | Hornecker | |
| 1,634,073 | A | 6/1927 | Labombarde | |
| 1,656,919 | A | 1/1928 | Marsh | |
| 1,762,704 | A | 6/1930 | Smith | |
| 1,901,483 | A | 3/1933 | Ware, Jr. | |
| 1,925,102 | A | 9/1933 | Levkoff | |
| 1,951,408 | A | 3/1934 | Haven | |
| 2,027,079 | A | 1/1936 | Weiss | |
| 2,141,743 | A | 12/1938 | Ethridge | |
| 2,145,430 | A | 1/1939 | New | |
| 2,152,079 | A | 3/1939 | Mott | |
| 2,196,243 | A | 4/1940 | Bensel | |
| 2,290,971 | A | 7/1942 | King | |
| 2,330,294 | A | 9/1943 | Leavitt et al. | |
| 2,416,332 | A | 2/1947 | Lehman | |
| 2,643,589 | A | 6/1953 | Weiss | |
| 2,679,349 | A | 5/1954 | Mullinix | |
| 2,710,134 | A | 6/1955 | Schroeder et al. | |
| 2,791,362 | A | 5/1957 | Nute | |
| 2,875,938 | A | 3/1959 | Bramhill | |
| 2,967,610 | A * | 1/1961 | Ebert et al. | 206/494 |
| 3,002,613 | A | 10/1961 | Merkel et al. | |
| 3,090,483 | A | 5/1963 | Altree et al. | |

(Continued)

FOREIGN PATENT DOCUMENTS

| | | |
|---|---|---|
| DE | 2 320 190 | 11/1973 |

(Continued)

*Primary Examiner* — David Fidei
(74) *Attorney, Agent, or Firm* — Womble Carlyle Sandridge & Rice, PLLC

(57) ABSTRACT

A combination shipping and dispensing carton contains a plurality of articles. The carton comprises a plurality of panels that extends at least partially around an interior of the carton. At least two end flaps are respectively foldably connected to respective panels of the plurality of panels and are overlapped with respect to one another to at least partially form a closed end of the carton. The carton is for shipping articles to the point of sale vendor and can be converted to a dispensing carton that displays the articles and allows removal of the articles from the carton.

27 Claims, 34 Drawing Sheets

U.S. PATENT DOCUMENTS

| | | | | | |
|---|---|---|---|---|---|
| 3,157,342 | A | | 11/1964 | Grady | |
| 3,265,283 | A | | 8/1966 | Farquhar | |
| 3,276,665 | A | | 10/1966 | Rasmussen | |
| 3,276,667 | A | * | 10/1966 | Johnson et al. | 206/557 |
| 3,280,968 | A | | 10/1966 | Craine | |
| 3,434,648 | A | | 3/1969 | Du Barry, Jr. | |
| 3,653,495 | A | | 4/1972 | Gray | |
| 3,677,458 | A | | 7/1972 | Gosling | |
| 3,721,339 | A | * | 3/1973 | Seyer | 206/557 |
| 3,759,378 | A | | 9/1973 | Werth | |
| 3,786,914 | A | | 1/1974 | Beutler | |
| 3,884,348 | A | | 5/1975 | Ross | |
| 4,008,849 | A | | 2/1977 | Baber | |
| 4,111,297 | A | * | 9/1978 | Paulin | 206/739 |
| 4,113,100 | A | | 9/1978 | Soja et al. | |
| 4,519,538 | A | | 5/1985 | Omichi | |
| 4,558,785 | A | | 12/1985 | Gordon | |
| 4,586,643 | A | | 5/1986 | Halabisky et al. | |
| 4,742,917 | A | | 5/1988 | Bornwasser | |
| 4,760,952 | A | | 8/1988 | Wachter et al. | |
| 4,773,541 | A | | 9/1988 | Riddell | |
| 4,815,609 | A | | 3/1989 | Kiedaisch | |
| 4,886,160 | A | | 12/1989 | Kligerman | |
| 5,181,650 | A | | 1/1993 | Hollander et al. | |
| 5,368,194 | A | | 11/1994 | Oliff et al. | |
| 5,505,372 | A | * | 4/1996 | Edson et al. | 229/121 |
| 5,509,534 | A | * | 4/1996 | Taravella et al. | 206/587 |
| 5,699,957 | A | | 12/1997 | Blin et al. | |
| 5,722,583 | A | | 3/1998 | Focke et al. | |
| 5,783,030 | A | | 7/1998 | Walsh | |
| 5,788,117 | A | | 8/1998 | Zimmanck | |
| 5,842,576 | A | | 12/1998 | Snow | |
| 5,857,570 | A | | 1/1999 | Brown | |
| 5,878,947 | A | | 3/1999 | Hoy et al. | |
| 5,881,884 | A | | 3/1999 | Podosek | |
| 5,921,398 | A | | 7/1999 | Carroll | |
| 5,927,498 | A | | 7/1999 | Saam | |
| 5,979,749 | A | | 11/1999 | Bozich | |
| 6,015,084 | A | | 1/2000 | Mathieu et al. | |
| D431,462 | S | | 10/2000 | Menaged et al. | |
| 6,129,211 | A | | 10/2000 | Prakken et al. | |
| 6,135,289 | A | | 10/2000 | Miller | |
| 6,158,579 | A | | 12/2000 | Rosenbaum | |
| 6,386,369 | B2 | | 5/2002 | Yuhas et al. | |
| 6,419,152 | B1 | | 7/2002 | Tokarski | |
| 6,435,351 | B1 | | 8/2002 | Gibb | |
| 6,478,159 | B1 | | 11/2002 | Taylor et al. | |
| 6,510,982 | B2 | | 1/2003 | White | |
| 6,523,692 | B2 | | 2/2003 | Gregory | |
| 6,729,475 | B2 | | 5/2004 | Yuhas et al. | |
| 6,811,028 | B2 | * | 11/2004 | Kim et al. | 206/587 |
| 6,854,639 | B2 | | 2/2005 | Walsh | |
| 6,913,189 | B2 | | 7/2005 | Oliff et al. | |
| 6,918,487 | B2 | | 7/2005 | Harrelson | |
| 6,923,365 | B2 | | 8/2005 | Auclair et al. | |
| 7,021,468 | B2 | | 4/2006 | Cargile, Jr. | |
| 7,201,714 | B2 | | 4/2007 | Zoeckler et al. | |
| 7,225,930 | B2 | | 6/2007 | Ford et al. | |
| 7,284,662 | B2 | | 10/2007 | DeBusk et al. | |
| 7,328,834 | B2 | | 2/2008 | Harrelson | |
| 2001/0001447 | A1 | | 5/2001 | Gregory | |
| 2002/0043554 | A1 | | 4/2002 | White | |
| 2002/0170845 | A1 | | 11/2002 | Oliff | |
| 2003/0024848 | A1 | * | 2/2003 | Oycke | 206/526 |
| 2004/0099570 | A1 | | 5/2004 | Cargile | |
| 2005/0092649 | A1 | | 5/2005 | Ford et al. | |
| 2005/0155905 | A1 | * | 7/2005 | Monk | 206/751 |
| 2005/0167291 | A1 | | 8/2005 | Sutherland | |
| 2005/0199690 | A1 | | 9/2005 | Peterson | |
| 2005/0218203 | A1 | | 10/2005 | Harrelson | |
| 2006/0243739 | A1 | | 11/2006 | Sherman et al. | |
| 2006/0266815 | A1 | | 11/2006 | Coltri-Johnson et al. | |
| 2007/0000934 | A1 | | 1/2007 | Wolpow | |
| 2009/0014353 | A1 | * | 1/2009 | Lewis et al. | 206/776 |

FOREIGN PATENT DOCUMENTS

| | | | | |
|---|---|---|---|---|
| DE | 36 27 019 | A1 | | 2/1988 |
| DE | 298 17 195 | U1 | | 11/1998 |
| DE | 202 16 854 | U1 | | 1/2003 |
| EP | 0 133 595 | A2 | | 2/1985 |
| EP | 0 704 386 | A1 | | 4/1996 |
| FR | 1.379.931 | | | 12/1963 |
| FR | 2 882 032 | | | 8/2006 |
| GB | 1 218 016 | | | 1/1971 |
| GB | 2238776 | A | * | 6/1991 |
| JP | 03275438 | A | * | 12/1991 |
| WO | WO 98/31593 | | | 7/1998 |
| WO | WO 03/082686 | A1 | | 10/2003 |
| WO | WO 2004/063031 | A1 | | 7/2004 |
| WO | WO 2005/110866 | A1 | | 11/2005 |

* cited by examiner

SHIPPING AND DISPENSING CARTON

CROSS-REFERENCE TO RELATED APPLICATIONS

This application claims the benefit of U.S. Provisional Application Ser. No. 61/059,136, which was filed on Jun. 5, 2008, and U.S. Provisional Application No. 61/189,343, which was filed on Aug. 18, 2008. The entire above-referenced provisional applications are hereby incorporated by reference for all purposes as if presented herein in their entirety.

BACKGROUND OF THE DISCLOSURE

The present disclosure generally relates to packages or cartons for holding, displaying, carrying, and dispensing containers.

SUMMARY OF THE DISCLOSURE

In general, one aspect of the disclosure is generally directed to a combination shipping and dispensing carton for containing a plurality of articles. The carton comprises a plurality of panels that extends at least partially around an interior of the carton. Wherein the interior is for containing the plurality of articles, and the plurality of panels comprising a first side panel, a second side panel, a bottom panel, and a top panel. At least two end flaps are respectively foldably connected to respective panels of the plurality of panels. Wherein the end flaps are overlapped with respect to one another to at least partially form a closed end of the carton. At least one line of separation at least partially divides the carton into a first portion and a second portion. Wherein the first and second portions are configured for being at least partially separated from one another along the line of separation to convert the carton from a shipping carton to at least one dispensing carton. In the dispensing carton, the first portion is a first dispensing portion for containing a first subset of the articles, and the second portion is a second dispensing portion for containing a second subset of the articles. The line of separation comprises at least one tear line for at least partially separating the first dispensing portion from the second dispensing portion. The carton further comprises article retaining features for retaining the plurality of articles.

In another aspect, the disclosure is generally directed to a combination shipping and dispensing carton for containing a plurality of articles. The carton comprises a plurality of panels that extends at least partially around an interior of the carton. Wherein the interior is for containing the plurality of articles. The plurality of panels comprises a first side panel, a second side panel, a bottom panel, and a top panel. A first plurality of end flaps are respectively foldably connected to respective panels of the plurality of panels for being at least partially overlapped to close a first end of the carton. A second plurality of end flaps are respectively foldably connected to respective panels of the plurality of panels for being at least partially overlapped to close a second end of the carton. The first plurality of end flaps comprises a first top end flap foldably connected to the top panel. The second plurality of end flaps comprises a second top end flap foldably connected to the top panel. A third top end flap is foldably connected to the top panel. The third top end flap being in an overlapping relationship with the first side panel. An opening section is at least partially defined by a tear line in the carton. The opening section is for forming a dispensing opening when the carton is converted from a shipping carton to a dispensing carton. The opening section comprises at least a portion of at least one of the first top end flap, the second top end flap, and the third top end flap.

In another aspect, the disclosure is generally directed to a blank for forming a combination shipping and dispensing carton for containing a plurality of articles. The blank comprises a plurality of panels comprising a first side panel, a second side panel, a bottom panel, and a top panel. At least two end flaps are respectively foldably connected to respective panels of the plurality of panels at one end of the blank. At least one line of separation at least partially divides the blank into a first portion and a second portion. Wherein the first and second portions are configured for being at least partially separated from one another along the line of separation to convert the carton erected from the blank from a shipping carton to at least one dispensing carton. In the at least one dispensing carton formed from the blank, the first portion is a first dispensing portion for containing a first subset of the articles, and the second portion is a second dispensing portion for containing a second subset of the articles. The line of separation comprises at least one tear line for at least partially separating the first portion from the second portion. The blank comprises article retaining features for retaining the plurality of articles.

In another aspect, the disclosure is generally directed to a blank for forming a combination shipping and dispensing carton for containing a plurality of articles. The blank comprises a plurality of panels comprising a first side panel, a second side panel, a bottom panel, and a top panel. A first plurality of end flaps are respectively foldably connected to respective panels of the plurality of panels at a first end of the blank. A second plurality of end flaps are respectively foldably connected to respective panels of the plurality of panels at a second end of the blank. The first plurality of end flaps comprise a first top end flap foldably connected to the top panel. The second plurality of end flaps comprises a second top end flap foldably connected to the top panel. A third top end flap is foldably connected to the top panel. The third top end flap is adapted for being placed in an overlapping relationship with the first side panel when the carton is formed from the blank. An opening section is at least partially defined by a tear line in the blank. The opening section is for forming a dispensing opening when the carton formed from the blank is converted from a shipping carton to a dispensing carton. The opening section comprises at least a portion of at least one of the first top end flap, the second top end flap, and the third top end flap.

In another aspect, the disclosure is generally directed to a method of enclosing and displaying a plurality of articles. The method comprising providing a carton. The carton comprises a plurality of panels comprising a first side panel, a second side panel, a bottom panel, and a top panel, at least two end flaps respectively foldably connected to respective panels of the plurality of panels, at least one line of separation comprising at least one tear line that at least partially divides the carton into a first dispensing portion and a second dispensing portion, and article retaining features for retaining the plurality of articles. The method further comprises enclosing a plurality of articles in the first dispensing portion and the second dispensing portion comprising positioning the articles in the carton so that the articles are retained by the article retaining features. The method comprises providing access to at least some of the plurality of articles. The providing of the access comprising separating the first and second dispensing portions of the carton from one another along the line of separation so that the first dispensing portion contains a first subset of articles and the second dispensing portion contains a second subset of articles.

BRIEF DESCRIPTION OF THE DRAWINGS

Corresponding parts are designated by corresponding reference numbers throughout at least some of the drawings included with the disclosure.

DETAILED DESCRIPTION OF THE EXEMPLARY EMBODIMENTS

The present disclosure generally relates to packages, cartons, constructs, sleeves, or the like, for shipping, holding, dispensing, and displaying containers such as cartons or packages holding food products, for example. The containers can be made from materials suitable in composition for packaging the particular food item, and the materials include, but are not limited to, cardboard, paperboard, plastics such as PET, LDPE, LLDPE, HDPE, PP, PS, PVC, EVOH, and Nylon, and the like, or other suitable materials.

Cartons according to the present disclosure can accommodate containers of numerous different shapes. For the purpose of illustration and not for the purpose of limiting the scope of the disclosure, the following detailed description describes food product containers at least partially disposed within the carton embodiments. In this specification, the terms "lower," "bottom," "upper," "top" and "side" indicate orientations determined in relation to fully erected cartons, and such terms are not intended to limit the scope of the disclosure.

Figure 2:
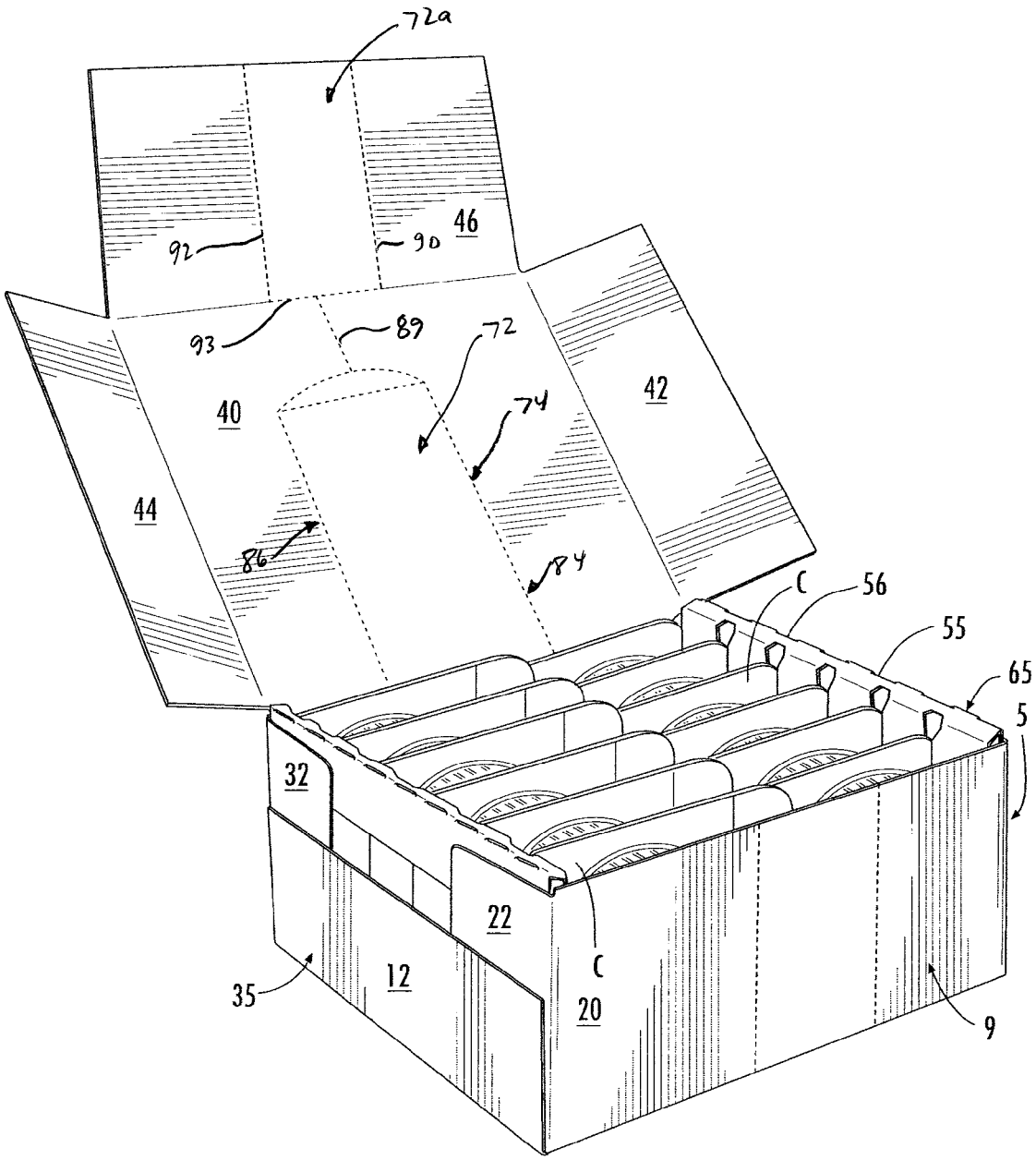
FIGS. 2-5 are various views of the carton of the first embodiment in various states of assembly.
Figure 3:
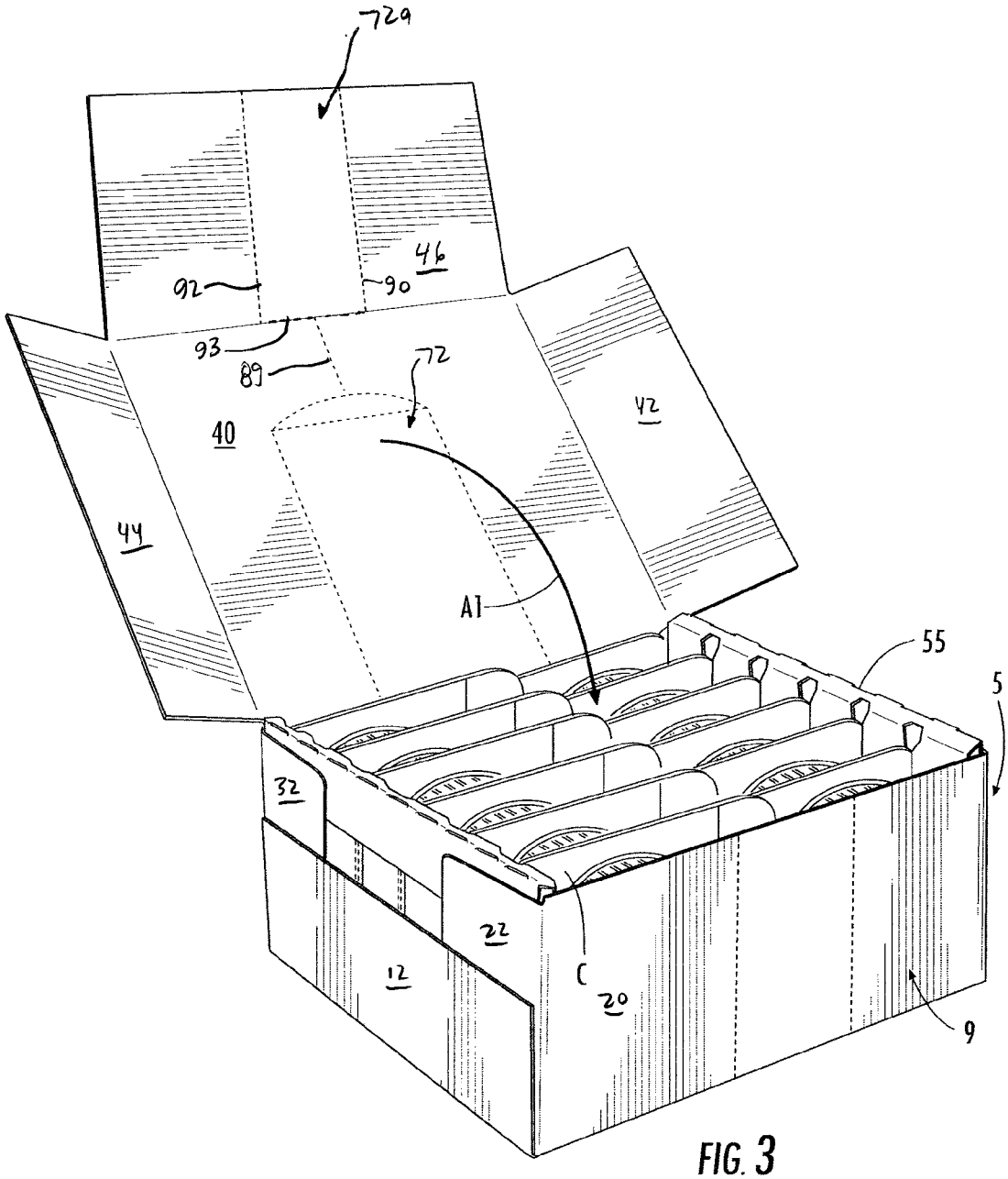
Figure 4:
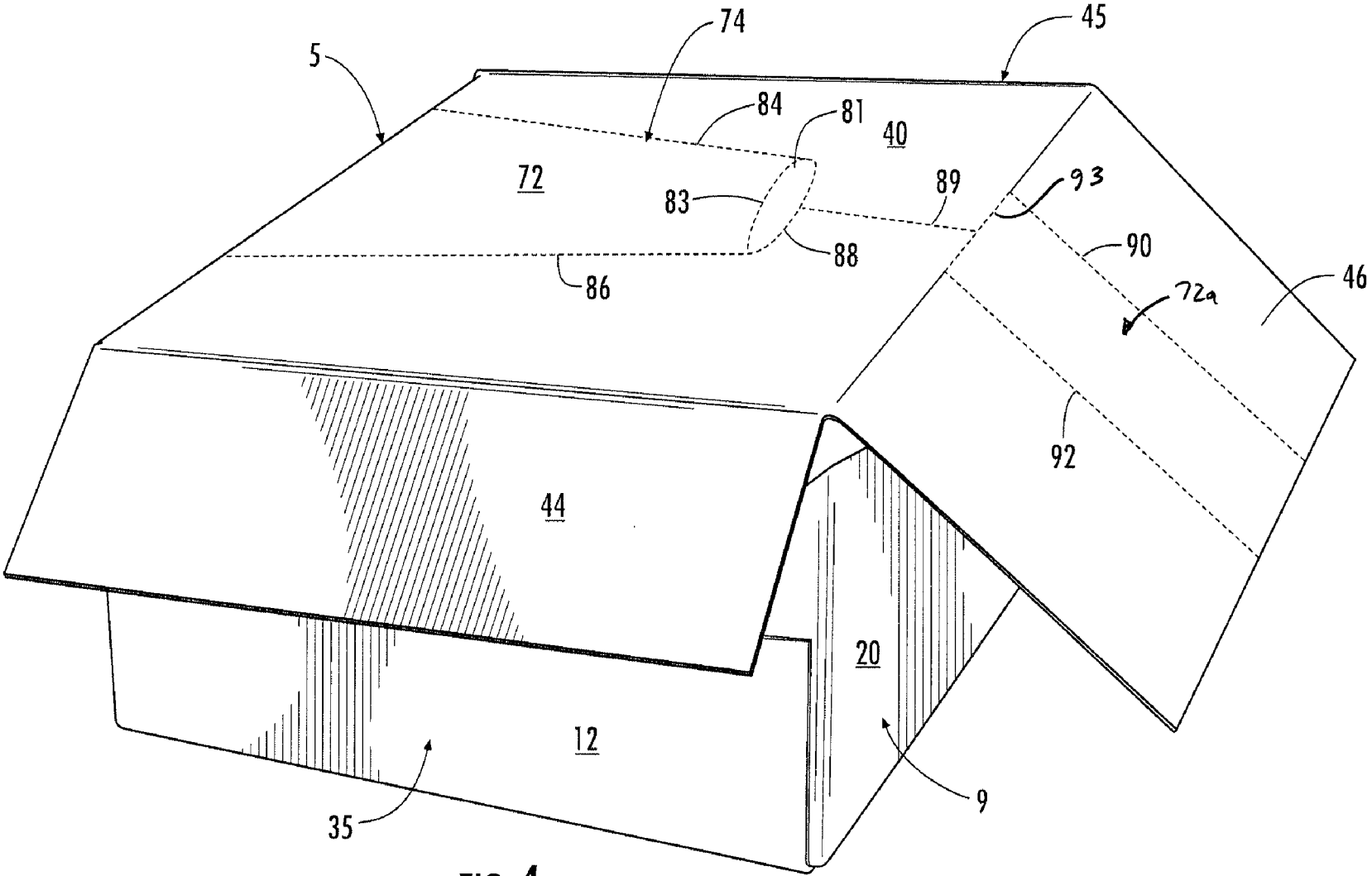

A shipping and dispensing carton 5 of a first embodiment is illustrated in its partially erected state in FIGS. 2-4, in which it holds food product containers C. In the embodiment of FIGS. 2-5, the containers C are illustrated as twelve food containers (e.g., resealable coldcut packages) housed in the carton 5. Less than or more than twelve containers C can be held in the carton 5, and the containers can be otherwise sized and shaped without departing from the disclosure. As described below, the containers C are contained in the carton 5 for shipping to a point-of-sale vendor (e.g., grocery store) where the carton 5 can be converted to one or more display or dispensing units 25 for displaying and dispensing the containers to consumers.

Figure 1:
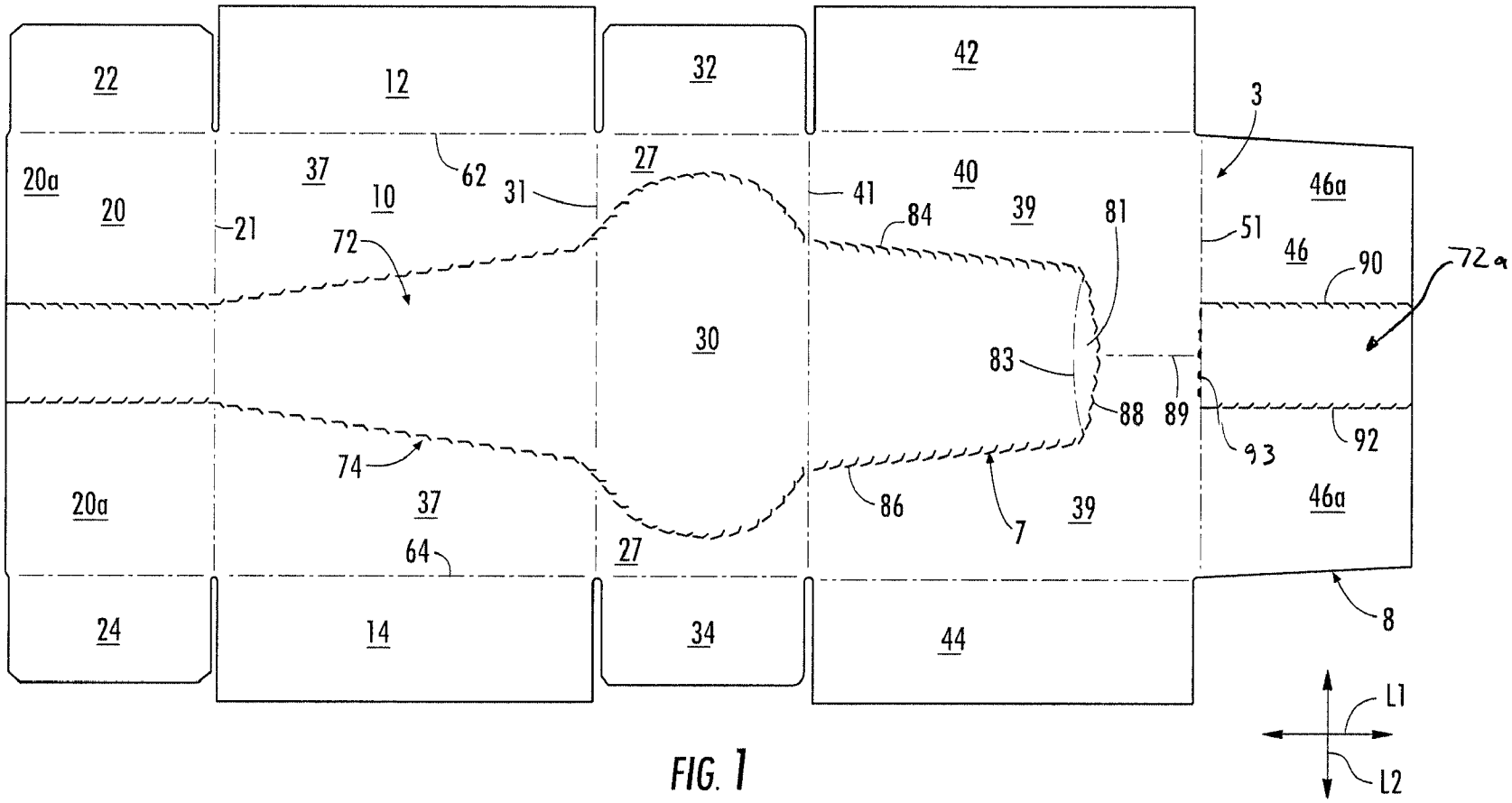
FIG. 1 is a plan view of an exterior surface of a blank for forming a shipping and dispensing carton according to a first embodiment of the disclosure.

FIG. 1 is a plan view of an exterior side 3 of a blank 8 used to form the carton 5. The blank 8 has a longitudinal axis L1 and a lateral axis L2. The blank 8 comprises a bottom panel 10 foldably connected to a first side panel 20 at a first transverse fold line 21, a second side panel 30 foldably connected to the bottom panel 10 at a second transverse fold line 31, and a top panel 40 foldably connected to the second side panel 30 at a third transverse fold line 41.

The bottom panel 10 is foldably connected to a first bottom end flap 12 and a second bottom end flap 14. The first side panel 20 is foldably connected to a first side end flap 22 and a second side end flap 24. The second side panel 30 is foldably connected to a first side end flap 32 and a second side end flap 34. The top panel 40 is foldably connected to a first top end flap 42, a second top end flap 44, and a third top end flap 46. When the carton 3 is erected, the top and bottom end flaps 12 and 42 and side end flaps 22 and 32 close a first end 35 of the carton 5, and the top and bottom end flaps 14 and 34 and side end flaps 24 and 44 close a second end 45 of the carton. In accordance with alternative embodiments of the present disclosure, different flap arrangements can be used for closing the ends 35, 45 of the carton.

The top and bottom end flaps 12 and 42 and side end flaps 22 and 32 extend along a first marginal area of the blank 8, and can be foldably connected at a first longitudinal fold line 62 that extends along the length of the blank. The top and bottom end flaps 14 and 44 and side end flaps 24 and 34 extend along a second marginal area of the blank 8, and can be foldably connected at a second longitudinal fold line 64 that also extends along the length of the blank. The longitudinal fold lines 62, 64 may be, for example, substantially straight, or offset at one or more locations to account for blank thickness or for other factors. In the illustrated embodiment, the third top end flap 46 is foldably connected to the top panel 40 at a lateral fold line 51.

In the illustrated embodiment, the blank 8 includes a removable opening section (e.g., sections), generally indicated at 72, removably attached to the blank 8 at a tear line (e.g., tear lines) (broadly "line of separation"), generally indicated at 74. Generally described, the opening section 72 is removed from the carton 5, the carton is converted to two display containers or portions 25 (FIG. 5) that hold and display the containers C. In the illustrated embodiment, the opening section 72 includes a portion of the top panel 40, bottom panel 10, side panels 20, 30, and top end flap 46. The opening section 72 includes an access flap 81 foldably attached to the top panel 40 at a fold line 83 extending between portions of the tear line 74 in the top panel. In one embodiment, the opening section 72 includes a portion 72*a* in the third top end flap 46.

In the illustrated embodiment, the tear line 74 includes a first portion 84 extending generally in the longitudinal direction L1 from one end of the fold line 83 in the top panel 40 to an edge of the side panel 20. A second portion 86 of the tear line is generally a mirror-image of the first portion 84 and extends from an opposite end of the fold line 83 in the top panel 40 to an edge of the side panel 20. In the illustrated embodiment, the first portion 84 and second portion 86 of the tear line 74 extend in the longitudinal direction L1 in the side panel 20, are oblique in the bottom panel 10, are curved in the second side panel 30, and are oblique in the top panel 40. The tear line 74 includes a third portion 88 in the top panel extending between respective ends of the first and second portions 84, 86. In the illustrated embodiment, the tear line 74 includes a fourth, longitudinal portion 89 generally located on the longitudinal centerline of the blank 8 and extending from the third portion 88 to the fold line 51. Fifth and sixth portions 90, 92 of the tear line extend generally longitudinally from an edge of the third top flap 46 to a seventh portion 93 of the tear line 74 that is collinear with the lateral fold line 51. The fifth, sixth, and seventh portions 90, 92, 93 of the tear line 74 define the portion 72*a* of the opening section in the third top flap. The tear line 74 and opening section 72 could be otherwise shaped, arranged, and/or positioned without departing from the scope of this disclosure.

In accordance with the exemplary embodiment, the blank 8 can be erected into the carton 5 by folding along fold lines 21, 31, 41, 51 and closing the ends 35, 45 by respectively overlapping and adhering the bottom end flaps 12, 14 and side end flaps 22, 32, 24, 34 to form a tray 9 (FIGS. 2-4). The containers C can be inserted into the tray 9. The tray 9 optionally has conventional inserts 55 at respective ends 35, 45 of the carton 5 for receiving the bottom edges of at least some of the containers C to align the containers in the carton. The inserts 55 have slots or apertures 56 that at least partially receive a portion (e.g., bottom edge) of the containers C. As shown in FIG. 2, the containers C are placed in two rows of six containers, but the containers could be otherwise arranged. The top panel 40 of the carton 5 is folded in the direction of arrow A1 (FIG. 2) so that the top panel is positioned to cover the tray 9 (FIG. 4). The top flaps 42, 44, 46 are secured to the tray to form a closed carton that is ready for shipment to the point-of-sale vendor. It is understood that closing, packing, and/or loading configurations and methods that differ than the closing, packing, and/or loading configurations discussed herein are within the scope of the disclosure.

Figure 5:
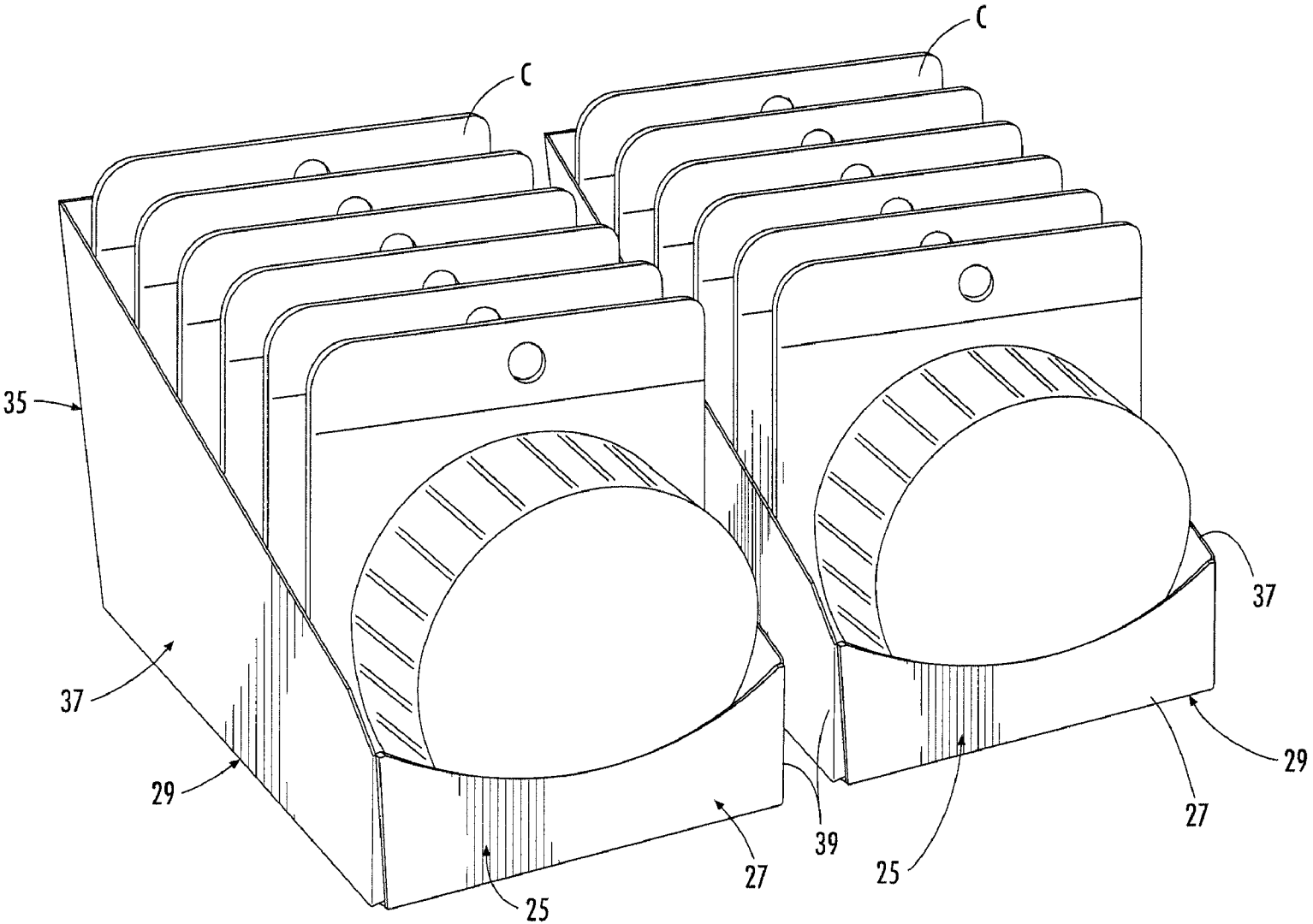

An exemplary opening process of the carton 5 is initiated by removing the opening section 72. The access flap 81 can be inwardly folded to grasp the opening section 72. The opening section 72 is removed by tearing the carton 5 along the tear line 74. Once the opening section 72 is removed (e.g., including tearing along longitudinal portion 89), the carton 5 is converted from a shipping carton into two display or dispensing cartons 25 (FIG. 5). The dispensing portions 25 each support one of the two rows of six containers C that were contained in the carton 5. The front wall 27 of each dispensing portion 25 comprises a portion of the second side wall 30 of the carton 5 that remains after removal of the opening section 72. The bottom wall 29 of each dispensing portion 25 comprise respective overlapped bottom end flaps 12, 14, top end flaps 42, 44, and side end flaps 22, 24, 32, 34. The back wall 35 of each dispensing portion 25 comprises overlapped portions 20*a*, 46*a* of the first side panel 20 and third top end flap 46. The first side wall 37 of each dispensing portion 25 comprises a portion of the bottom panel 10 of the carton 5 that remains after removal of the opening section 72. The second side wall 39 of each display portion 25 comprises a portion of the top panel 40 of the carton 5 that remains after removal off the opening section 72. Each dispensing portion 25 with containers C can be positioned on a shelf such as a refrigerated food display case for viewing and selection of the containers by the customer.

Figure 6:
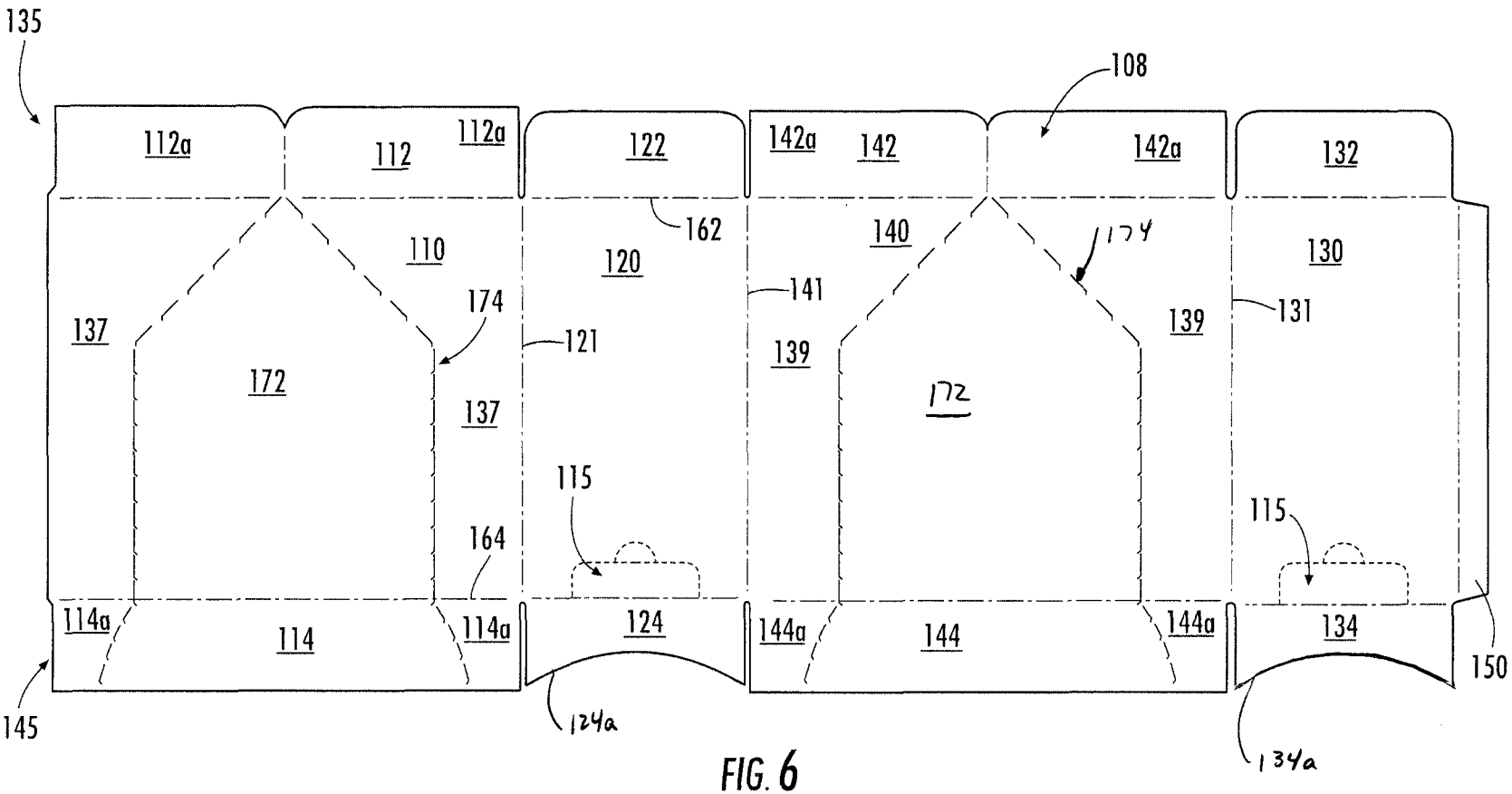
FIG. 6 is a plan view of an exterior surface of a blank for forming a shipping and dispensing carton according to a second embodiment of the disclosure.

FIG. 6 shows a second embodiment of the blank 108 for being formed into a carton 105 (FIG. 7) having similar features as the carton 5 of the first embodiment. Accordingly, similar or identical features of the embodiments are provided with like reference numbers.

The blank 108 has a bottom panel 110 foldably connected to a first side panel 120 at a lateral fold line 121, a top panel 140 foldably connected to the first side panel 120 at a lateral fold line 141, and a second side panel 130 foldably connected to the top panel 140 at a lateral fold line 131. The opening section 172 (e.g., opening sections) of the blank 106 is formed by tear lines 174 that are respectively in bottom end flaps 112, 114, bottom panel 110, bottom end flaps 142, 144, and top panel 140. The side panels 120, 130 include support flaps 115 (e.g., defined by a tear line) respectively foldably connected to the side panels at respective portions of the longitudinal fold line 164. The blank 108 could be otherwise, shaped, arranged, and/or configured without departing from the disclosure.

The carton 105 formed by the blank 108 is generally formed into an open-ended sleeve by folding panels 110, 120, 130, 140 about respective fold lines 121, 131, 141 and adhering an adhesive panel 150 to the bottom panel 110. The containers C are loaded into the carton 105 in a similar 2×6 arrangement as the containers of the first embodiment. After loading the containers C into the open-ended sleeve, the end flaps 112, 122, 132, 142 are closed at one end 135 of the carton and the end flaps 114, 124, 134, 144 are closed at the other end 145 of the carton. The loaded and closed carton 105 is shipped to the point-of-sale vendor. In the illustrated embodiments, the end flap 124, 134 have respective curved edges 124*a*, 134*a*. Alternative folding and/or closing arrangements could be used.

Figure 7:
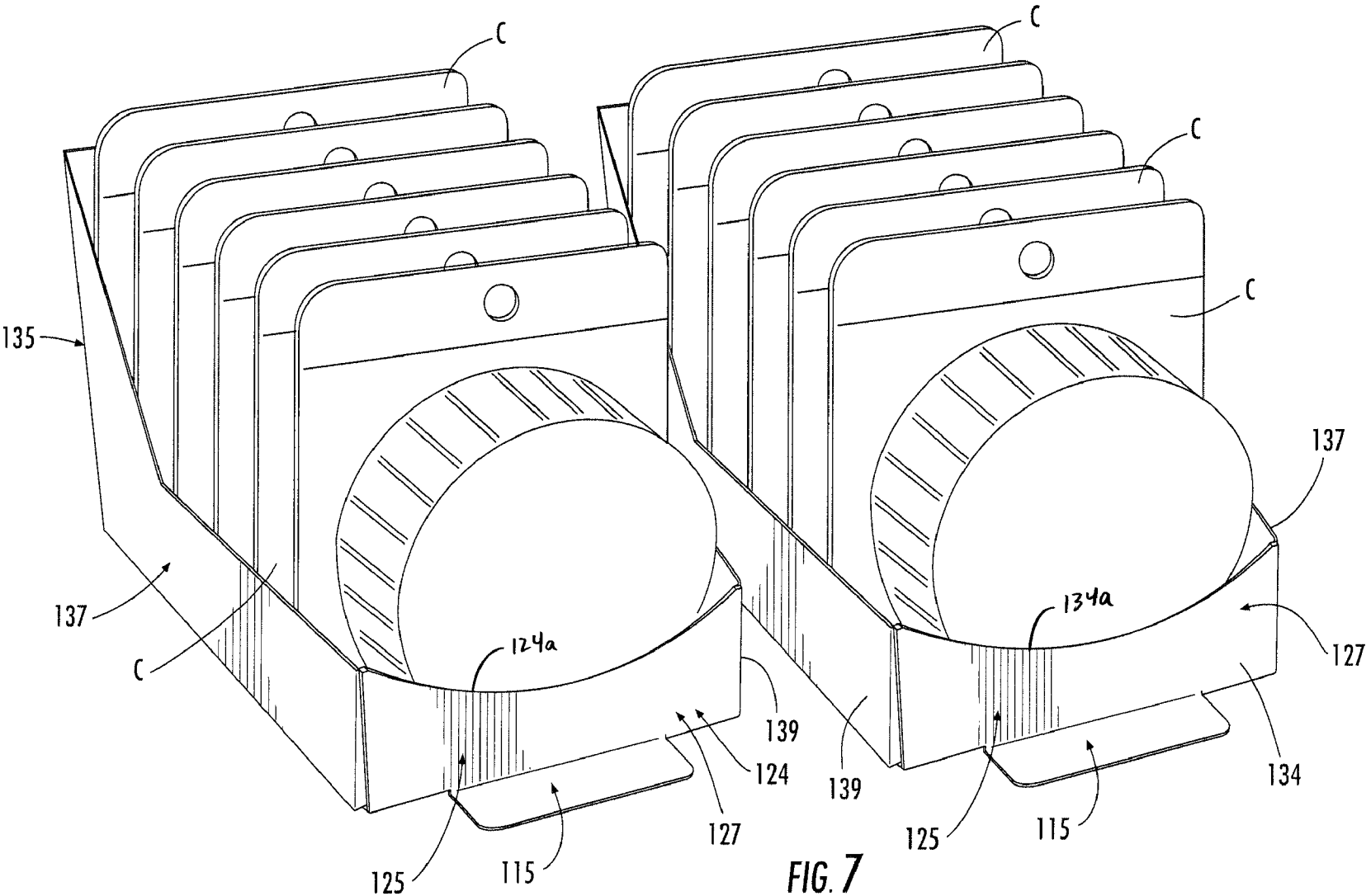
FIG. 7 is a perspective view of the carton of the second embodiment converted to a first and second dispensing carton

As shown in FIG. 7, the carton 105 formed by the blank 108 is converted to a display carton by removing the opening section(s) 172 to divide the carton into two display portions 125 similar to the display portions 25 of the first embodiment. The front wall 127 of each dispensing portion comprises a respective side end flap 124, 134 that is overlapped with portions 114*a* of the bottom end flap 114 or portions 144*a* of the top end flap 134 that remain after removal of the opening section 172. The side walls 137 of the display portions 125 comprise portions of the bottom panel 110 that remain after removal of the opening section 172. The side walls 139 of the display portions comprise portions of the top panel 130 that remain after removal of the opening section 172. Each of the back walls 135 of the display portions 125 comprise a respective side end flap 122, 132 that is overlapped with a portion 112*a* of the bottom end flap 112 and a portion 142*a* of the top end flap 142. A portion of the tear line 174 separates respective portions 112*a*, 142*a* of the end flaps 112, 114 so that the portions 112*a*, 142*a* of end flaps 112, 142 are separated when the opening section 172 is removed. Each of the support flaps 115 can be folded relative to a respective front wall 127 to support each of the display portions 125. The display portions 125 can be otherwise shaped, arranged, and/or configured without departing from the scope of this disclosure.

Figure 8:
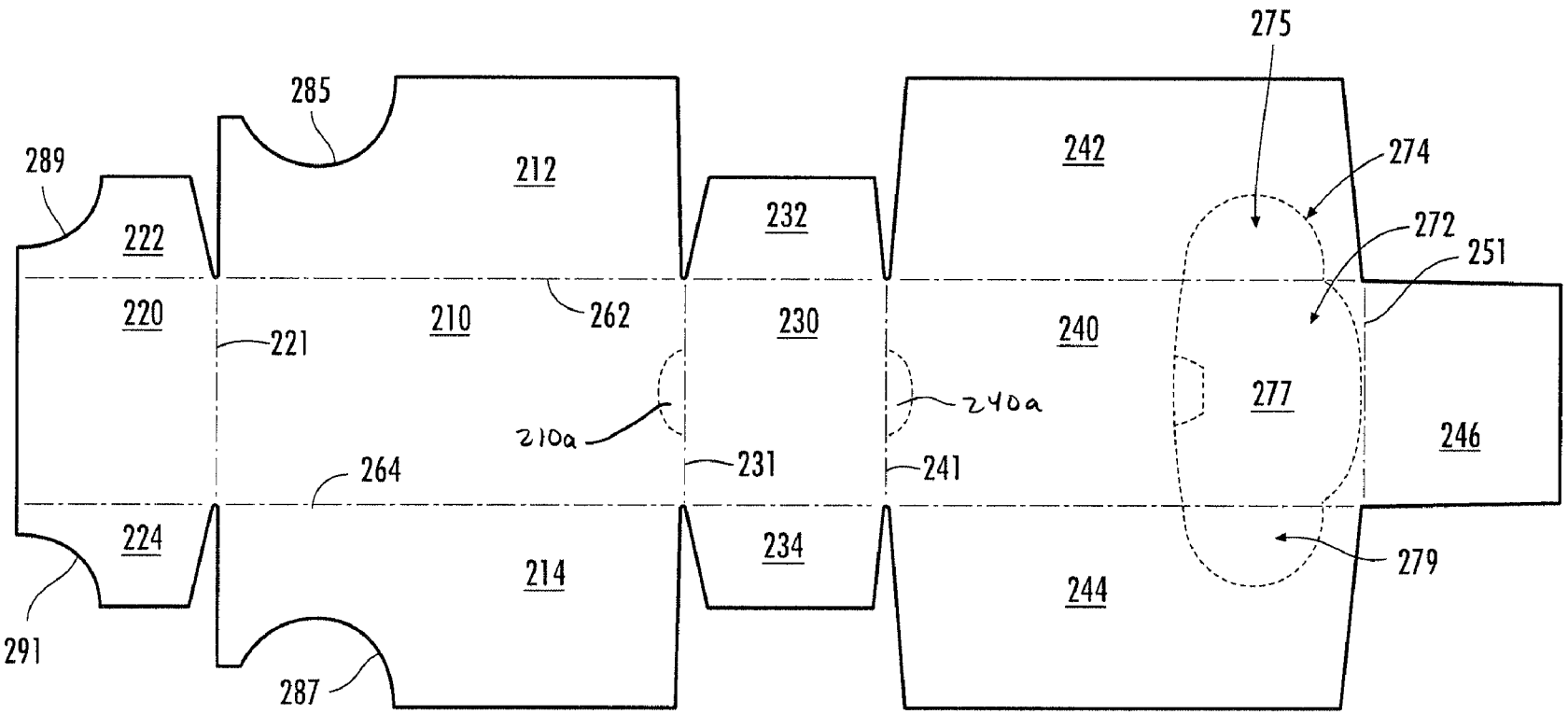
FIG. 8 is a plan view of an exterior surface of a blank for forming a shipping and dispensing carton according to a third embodiment of the disclosure.

FIG. 8 shows a third embodiment of the blank 208 for being formed into a shipping and dispensing carton 205 (FIGS. 9-12) having similar features as the cartons 5, 105 of the first and second embodiment. Accordingly, similar or identical features of the embodiments are provided with like reference numbers.

The blank 208 comprises a bottom panel 210 foldably connected to a first side panel 220 at a first transverse fold line 221, a second side panel 230 foldably connected to the bottom panel 210 at a second transverse fold line 231, and a top panel 240 foldably connected to the second side panel 230 at a third transverse fold line 241. End flaps 212, The blank 208 has an opening section 272 formed by a tear line 274. In the illustrated embodiment, the top panel 240 includes a first handle flap 240*a* foldably connected to the second side panel 230 at the fold line 241, and the bottom panel 210 includes a second handle flap 210*a* foldably connected to the second side panel at the fold line 231. The first and second handle flaps 210*a*, 240*a* can be for carrying or mounting the shipping and dispensing carton 205. The blank 208 includes first end flaps 212, 222, 232, 242 respectively foldably connected to the panels 210, 220, 230 at a first longitudinal fold line 262 and second end flaps 214, 224, 234, 244 respectively foldably connected to the panels at a second longitudinal fold line 264. A third top flap 246 is foldably connected to the top panel 240 at a lateral fold line 251. In the illustrated embodiment, the opening section 272 is formed by a tear line 274. The opening section 273 includes a portion 275 in the first top end flap 242, a second portion 277 in the top panel 240, and a portion 279 in the second top end flap 244. The end flaps 212, 214 include curved cutouts 285, 287 (or curved tear-out) and the end flaps 222, 224 include curved cutouts 289, 291 (or curved tear-out). The cutouts 285, 289 overlap and correspond to the first portion 275 of the opening section 272 when the blank 208 is formed into the carton 205. The cutouts 287, 291 correspond to the third portion 279 of the opening section 272 when the blank is formed into the carton 205.

Figure 9:
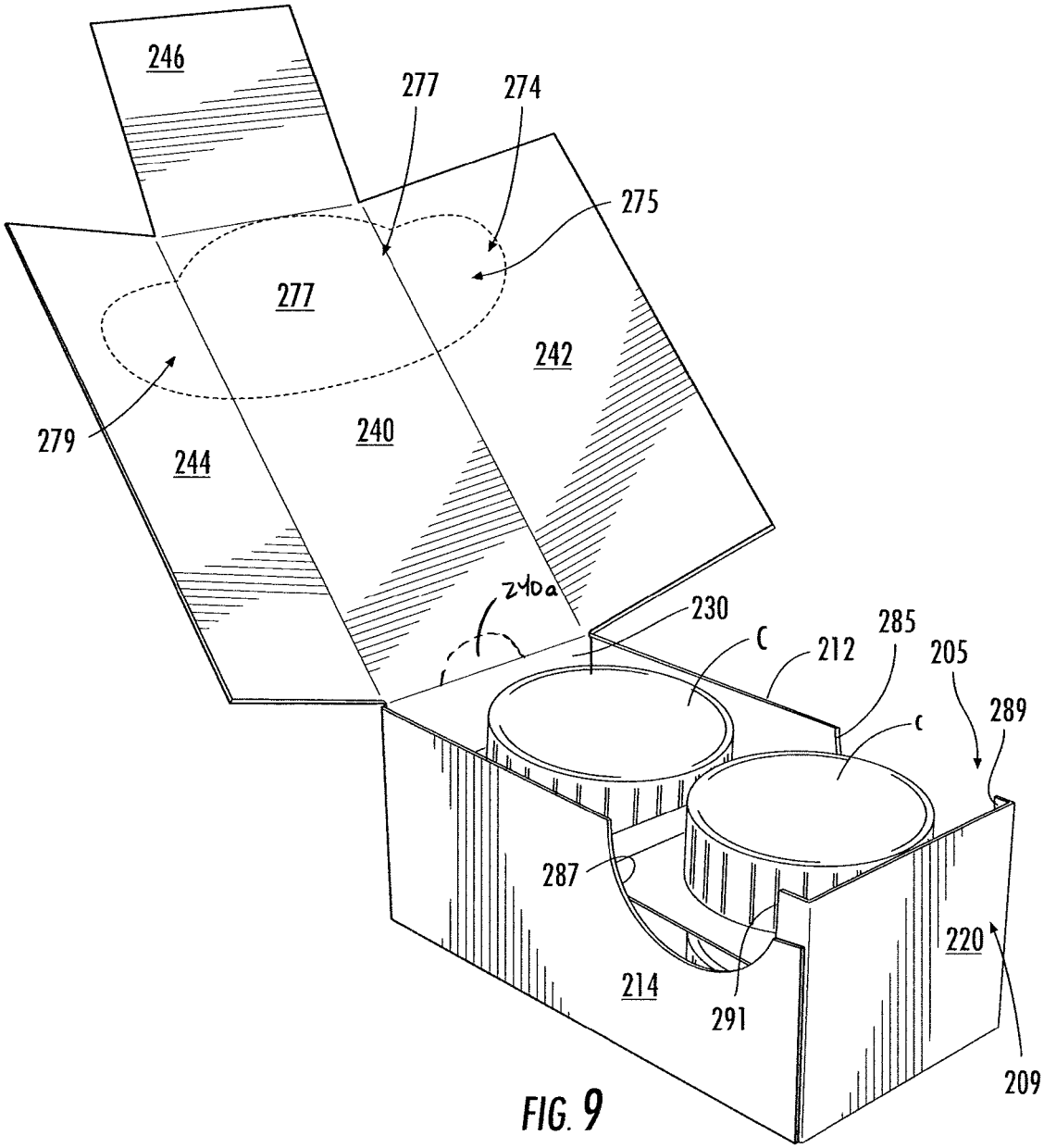
FIGS. 9-11 are various views of the carton of the third embodiment in various states of assembly.
Figure 10:
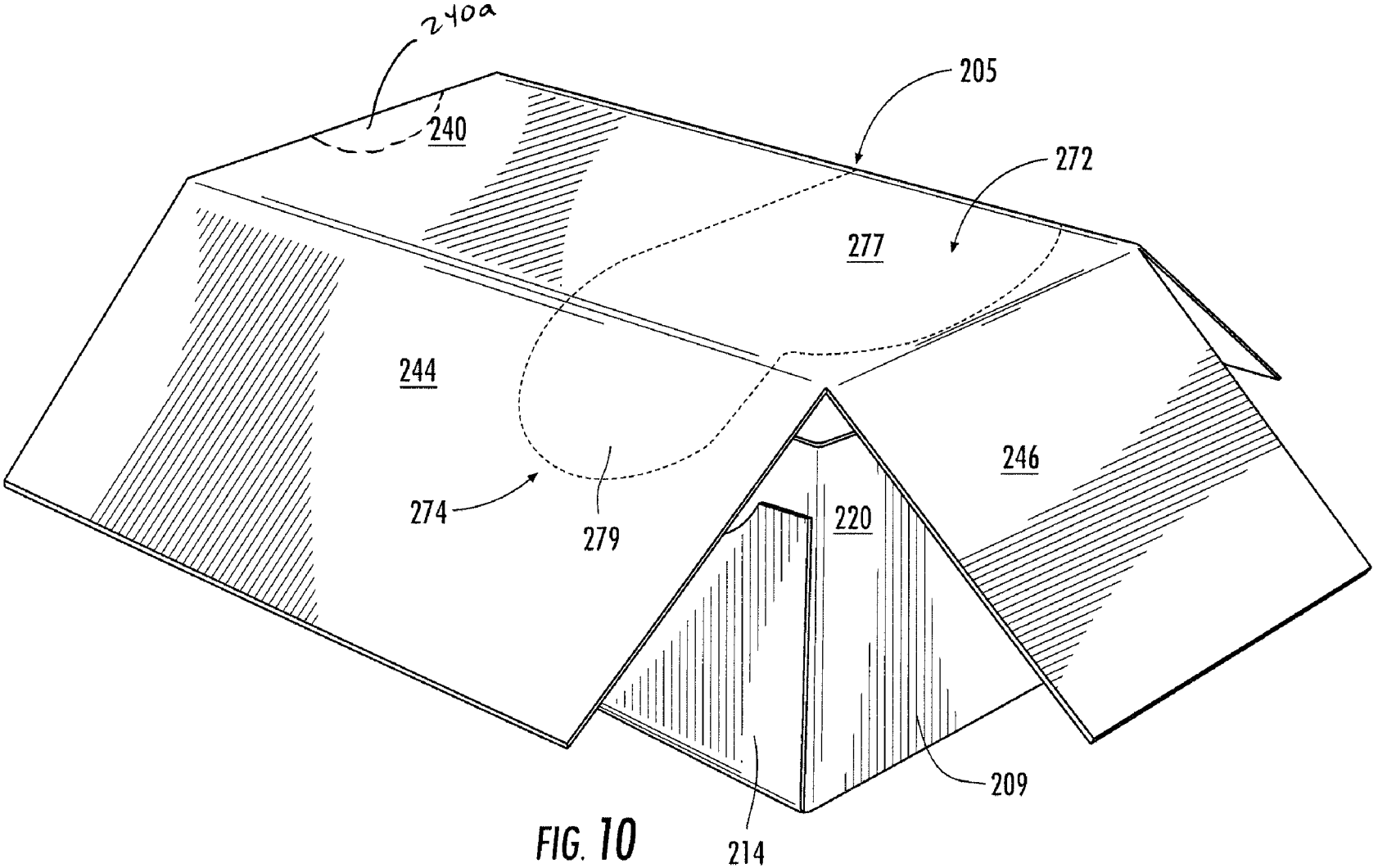
Figure 11:
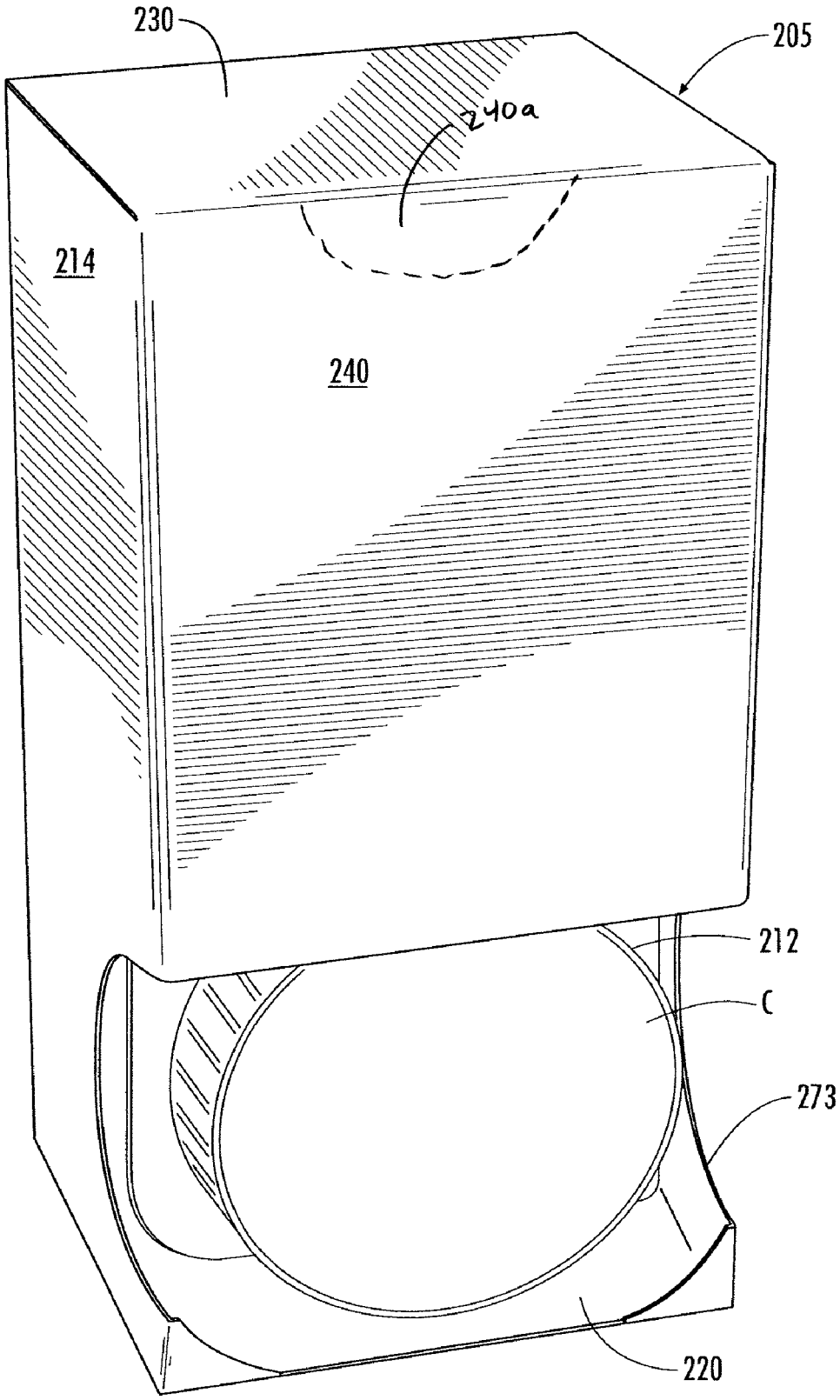

As shown in FIGS. 9-11, the blank 208 is partially formed into the carton 205 by forming the tray 209. In the illustrated embodiment, six containers C are loaded into the tray 209 and are positioned in two stacks of three containers. The top panel 240 is downwardly folded and the end flaps 242, 246, 244 are secured to close the carton 205.

Containers C are dispensed from the carton one after the other by tearing at tear line 274 to remove the opening section 272 to form a dispensing opening 273 for removing the containers from the carton 205. The dispensing opening 273 can be otherwise shaped, arranged, and/or located without departing from the disclosure.

Figure 12:
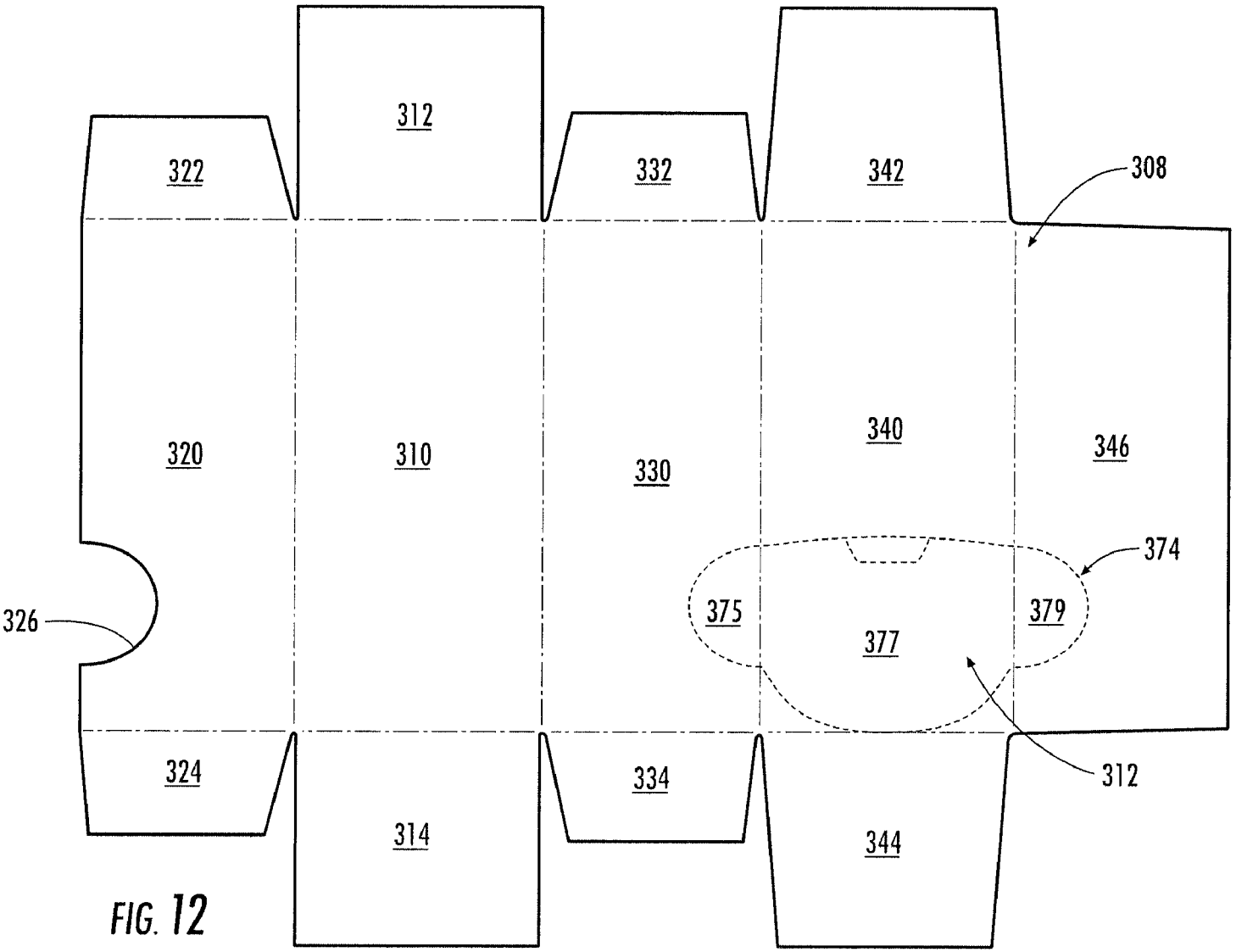
FIG. 12 is a plan view of an exterior surface of a blank for forming a shipping and dispensing carton according to a fourth embodiment of the disclosure.
Figure 13:
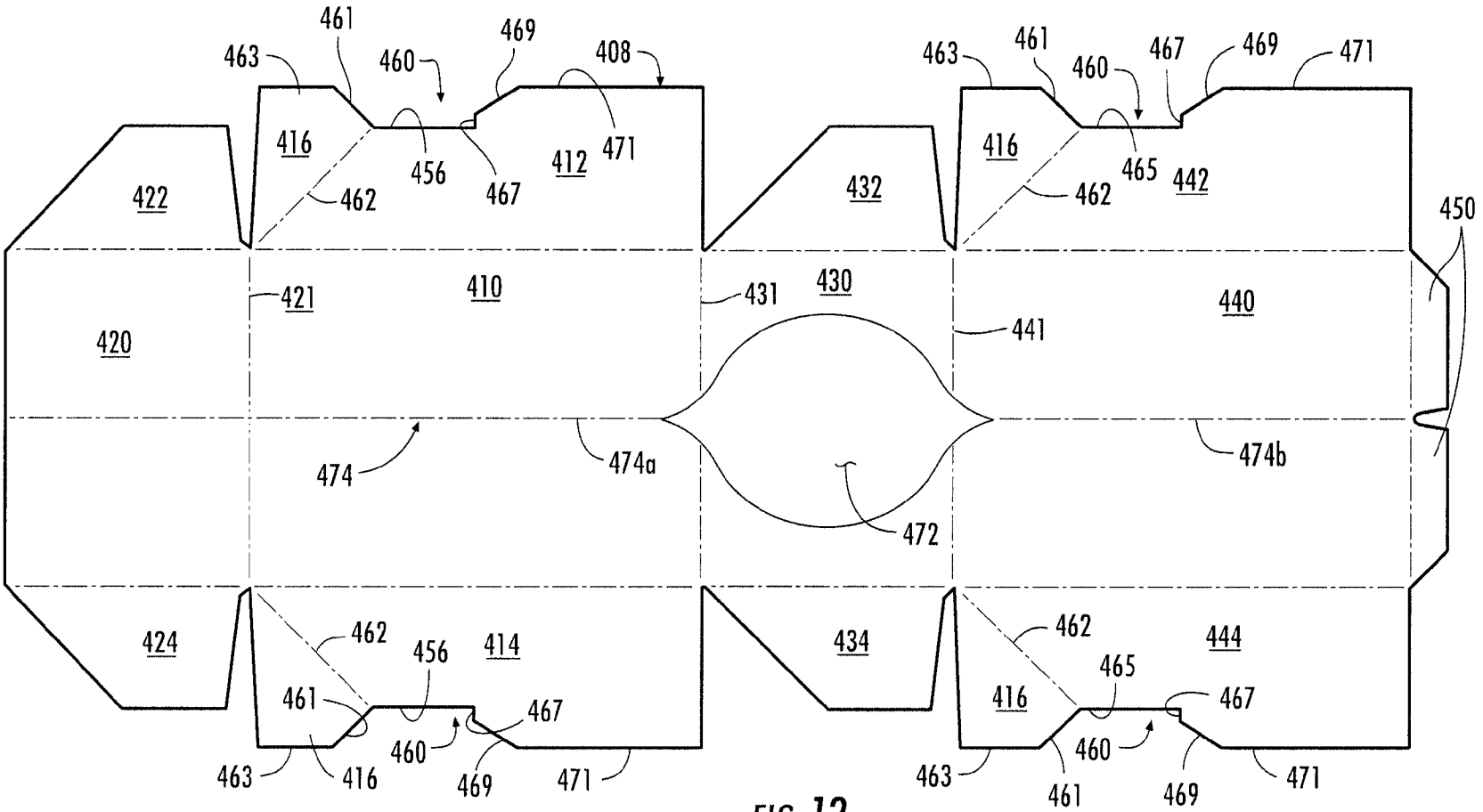
FIG. 13 is a plan view of an exterior surface of a blank for forming a shipping and dispensing carton according to a fifth embodiment of the disclosure.
Figure 14:
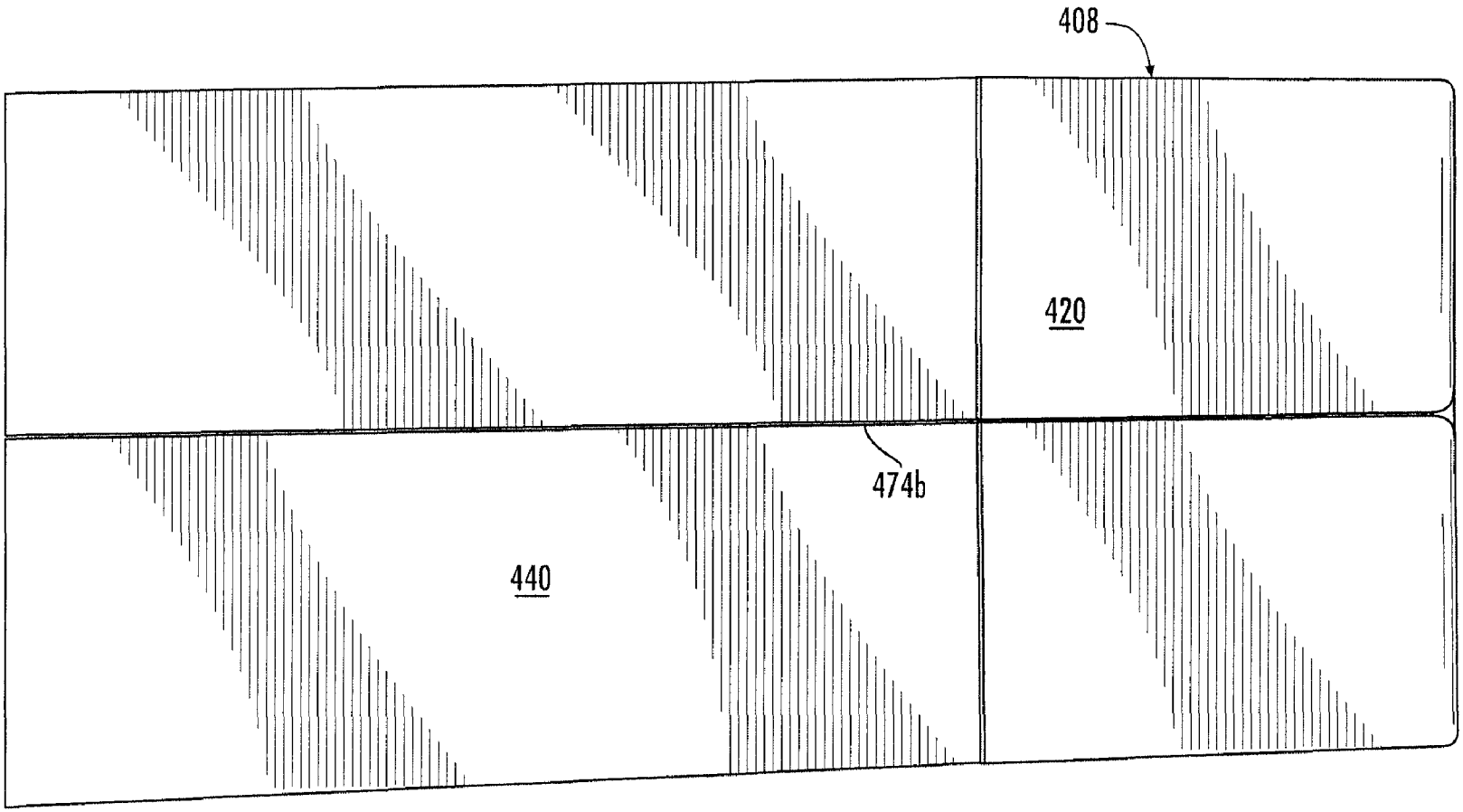
FIGS. 14-19 are various views of the carton of the fifth embodiment in various states of assembly.

FIG. 12 shows a fourth embodiment of the blank 308 for being formed into a shipping and dispensing carton (not shown) having similar features as the carton 205 of the previous embodiment. Accordingly, similar or identical features of the embodiments are provided with like reference numbers. In the embodiment of FIGS. 13 and 14, the opening section 372 includes a first portion 375 in the second side panel 330, a second portion 377 in the top panel 340, and a third portion 379 in the third top end flap 346. The first side panel 320 includes a notch 326 in an edge thereof. The top of the carton is formed by overlapping end flaps 312, 322, 332, 342 and the bottom of the carton is formed by overlapping end flaps 314, 324, 334, and 344.

The carton formed from the blank 308 functions in a similar manner as the carton 205 in that containers C may be dispensed from the carton 305 through the dispensing opening 373 formed when the opening section 372 is removed.

FIG. 13 shows a fifth embodiment of the blank 408 for being formed into a shipping and dispensing carton 405 having similar features as the cartons 5, 105, 205, 305 of the previous embodiments. Accordingly, similar or identical features of the embodiments are provided with like reference numbers.

In the illustrated embodiment, the blank 408 has an opening 472 (or tear out) in the second side panel 430 that partially extends into the bottom panel 410 and the top panel 440. A tear line 474 is generally located at a longitudinal centerline of the blank 408 so that the blank is generally a mirror-image about the longitudinal centerline. The tear line has a first portion 474*a* extending longitudinally from the opening 472 in the bottom panel 410 to an edge of the first side panel 420 and a second portion 474*b* extending longitudinally from the opening 472 in the top panel to an edge of the blank 408 that is located between glue panels 450. As with the previous embodiments, the carton 405 can be converted to two display or dispensing portions 425 (FIGS. 17-19) for holding and displaying containers C. The carton 405 can be converted to the display portions 425 by tearing along tear line 474. Alternatively, the opening 472 could be an opening section of the blank 408 that is removed upon tearing along tear line 474.

The end flaps 412, 422, 432, 442 at one end 435 of the carton 405 and the end flaps 414, 424, 434, 444 at the other end 445 of the carton have "auto bottom" closure features that provide a secure closure for the ends of the carton. Alternatively, only one end 435, 445 or neither end of the carton 405 can have the auto bottom closure features incorporated into the corresponding end flaps. The auto bottom closure features of the ends 435, 445 of the carton are similar to the auto-bottom features shown and described in U.S. Provisional Patent Application No. 12/269,308, filed Nov. 12, 2008, the entire contents of which is incorporated by reference for all purposes.

The auto bottom closure features at each end 435, 445 of the carton 405 comprises a first major flap 412, 414 foldably connected to the bottom panel 410, a first minor flap 422, 424 foldably connected to the first side panel 420, a second major flap 442, 444 foldably connected to the top panel 440, and a second minor flap 432, 434 foldably connected to the second side panel 430. The major flaps 412, 414, 442, 444 include closure features 460 struck from end edges of the blank 408.

In the illustrated embodiment, the closure feature 460 in each of the major flaps 412, 414, 442, 444 is an open aperture or recessed portion formed by an oblique edge 461 extending from a first longitudinal exterior edge 463, a longitudinal interior edge 465, a shoulder 467, an oblique edge 469 extending away from the shoulder to a second longitudinally extending exterior edge 471. An oblique crease fold line 462 can be formed in each of the major flaps 412, 414, 442, 444 to define a foldable or hinged section 416 in each of the major flaps. The closure feature 460 could be otherwise shaped, arranged, and positioned without departing from the disclosure.

Figure 15:
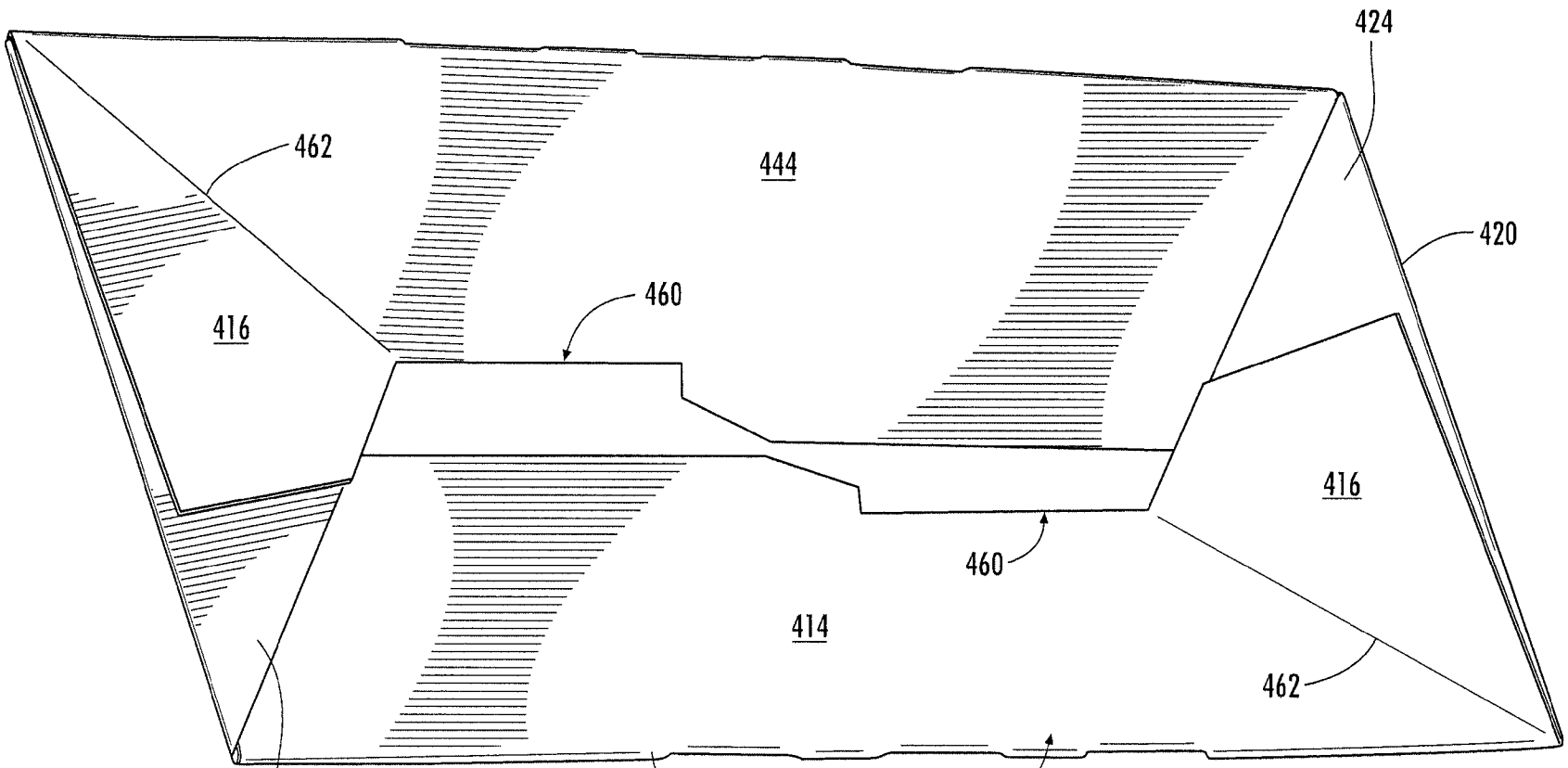
Figure 16:
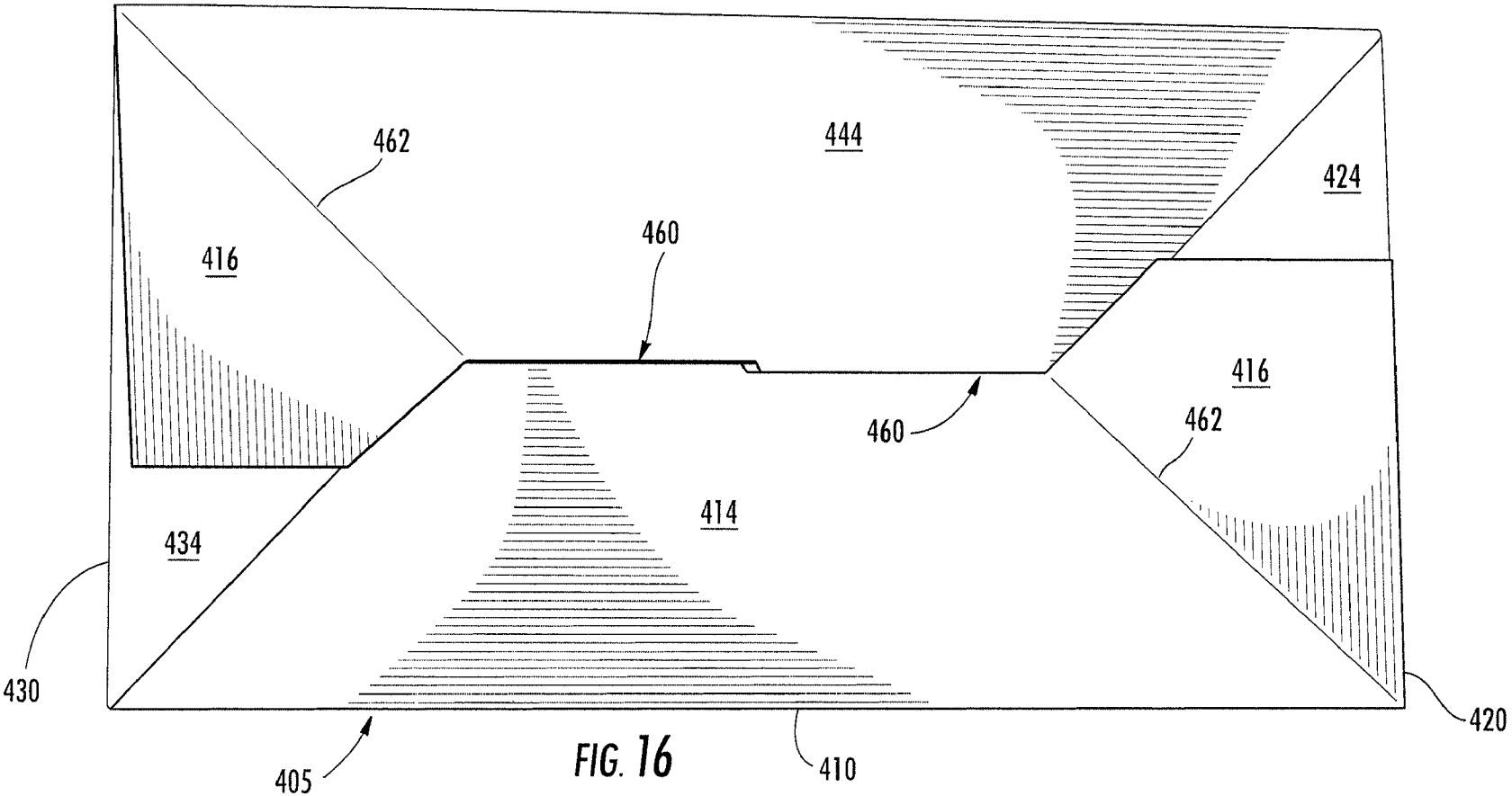

The blank 408 is partially assembled into the carton 405 by attaching the adhesive flaps 450 to the first side panel 420 and respectively folding the panels 410, 420, 430, 440 about fold lines 421, 431, 441. The hinged section 416 of each major flap 412, 414, 442, 444 can be respectively adhesively attached to an adjacent minor flap 422, 424, 432, 434. The partially assembled blank 408 can be positioned in a flat arrangement shown in FIG. 14. The blank 408 is assembled into the carton 405 by upwardly folding the side panels 420, 430 so that the top panel 440 is spaced-apart from the bottom panel 410 by the upwardly struck side panels 420, 430. As shown in FIGS. 15-16, when the side panels 420, 430 are upwardly struck from the bottom panel 410, the auto bottom feature of the end flaps 412, 422, 432, 442 is activated to close the end 435 of the carton and the auto bottom features of the end flaps 414, 424, 434, 444 is activated to close the end 445 of the carton without any additional folding or overlapping operation. Alternative closing and/or folding operations could be used without departing from the scope of the disclosure.

Figure 17:
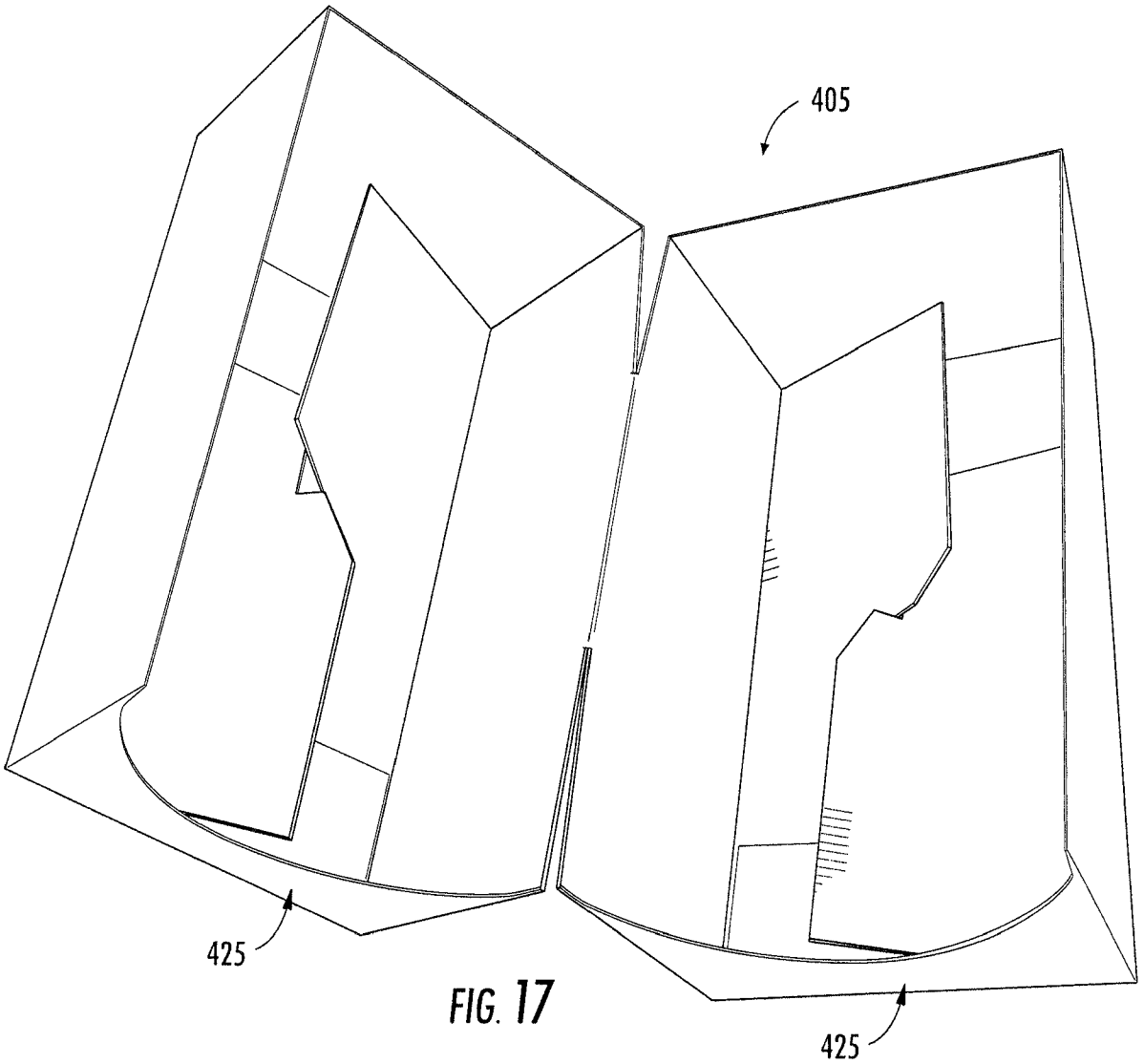
Figure 18:
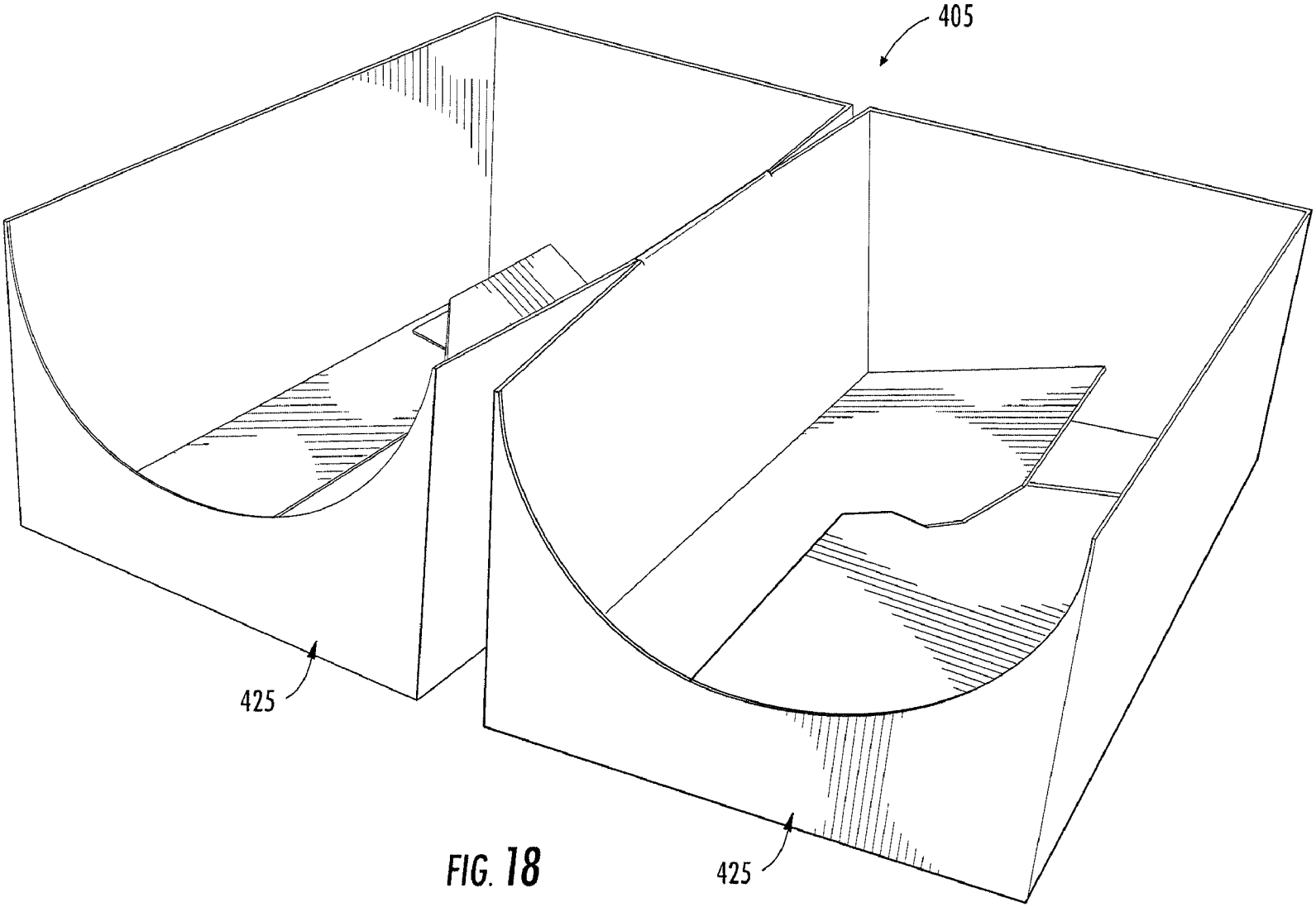
Figure 19:
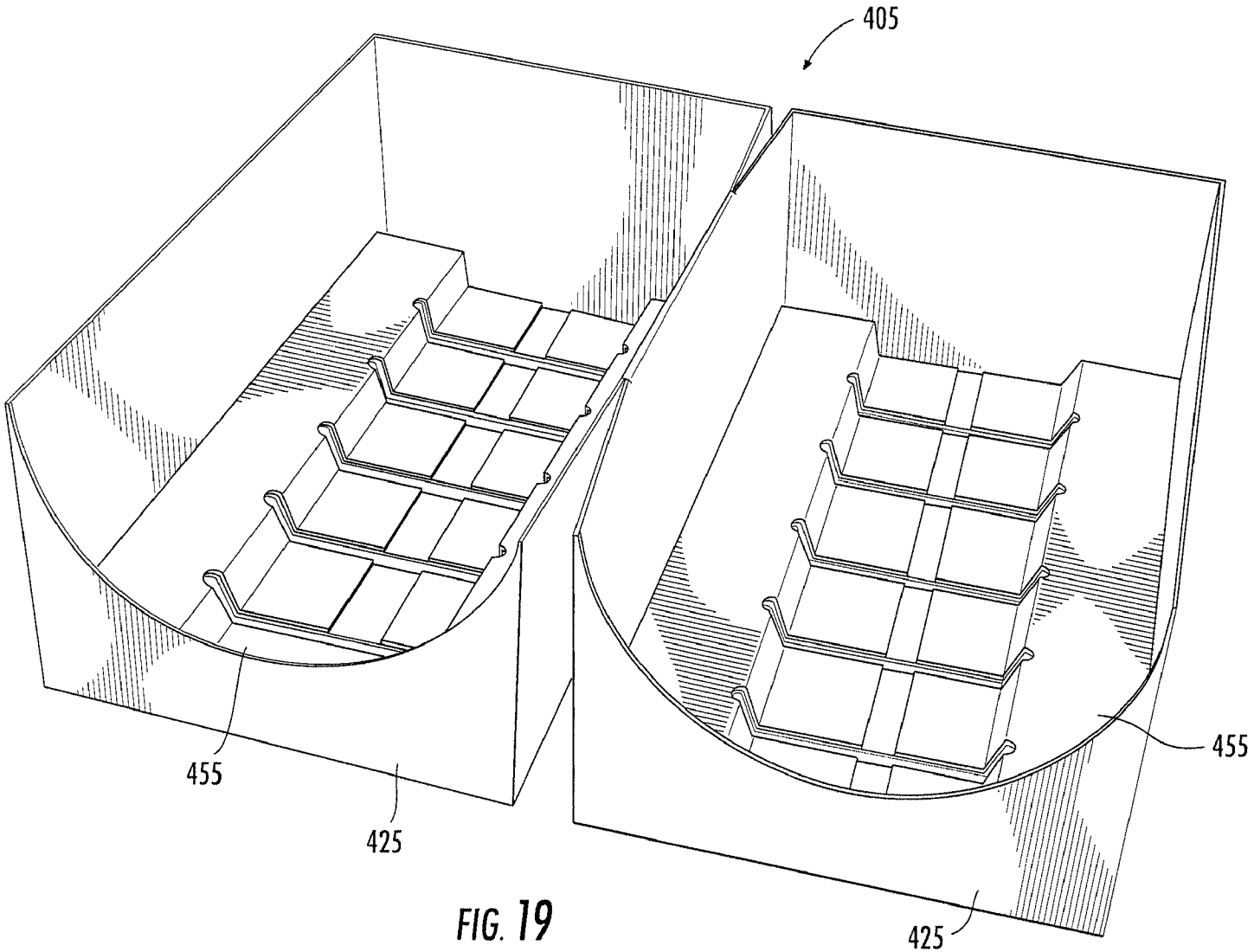

As shown in FIGS. 17-19 the carton 405 is converted to the two display portions 425 by tearing along tear line 474. The tear line 474 may be torn when the auto bottom flaps at each end 435, 445 of the carton are activated to close a respective end of the carton. Alternatively, the two display portions 425 may be separated by tearing at tear line 474 after the blank 408 is assembled into the carton 405.

Figure 20B:
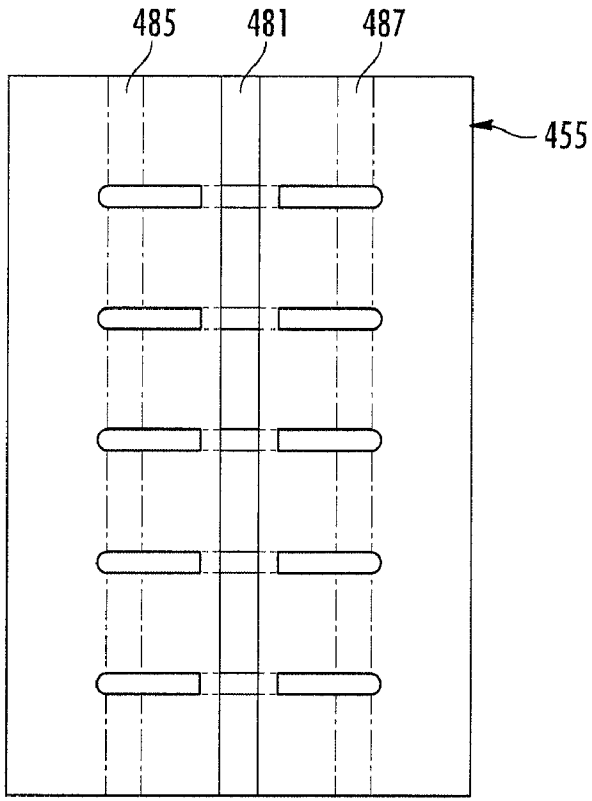
FIG. 20B is a plan view of the insert formed from the blank of FIG. 20A.
Figure 20A:
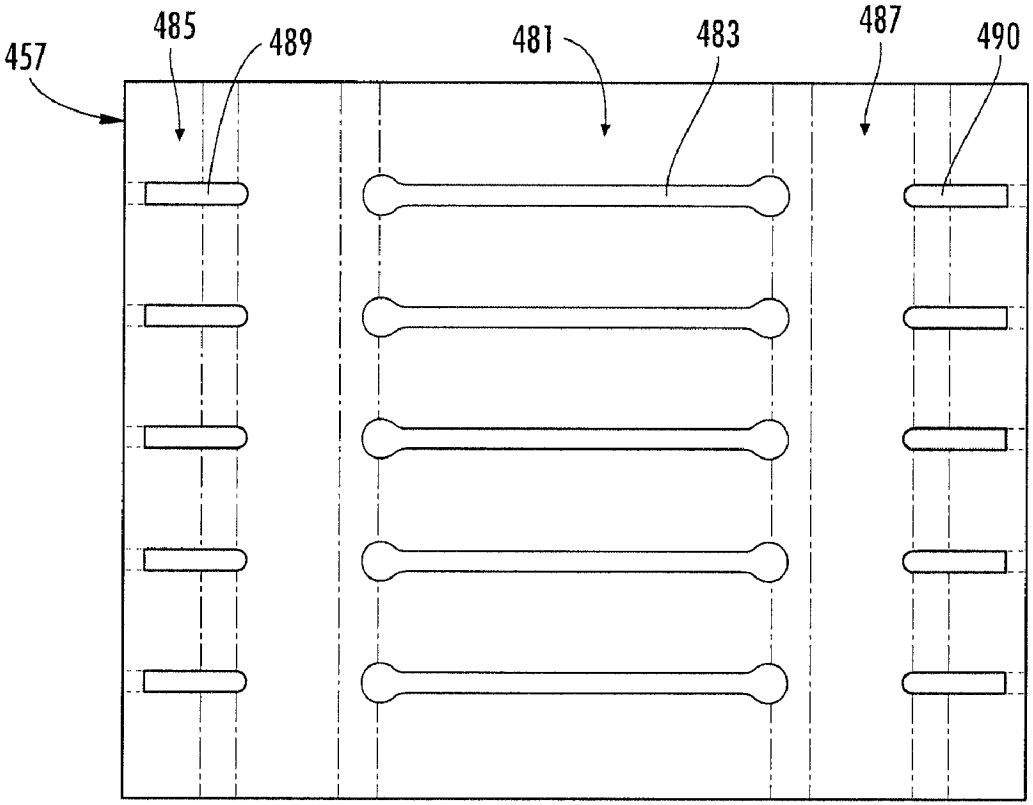
FIG. 20A is a plan view of a blank for forming an insert used in various embodiments of the shipping and dispensing carton.
Figure 21:
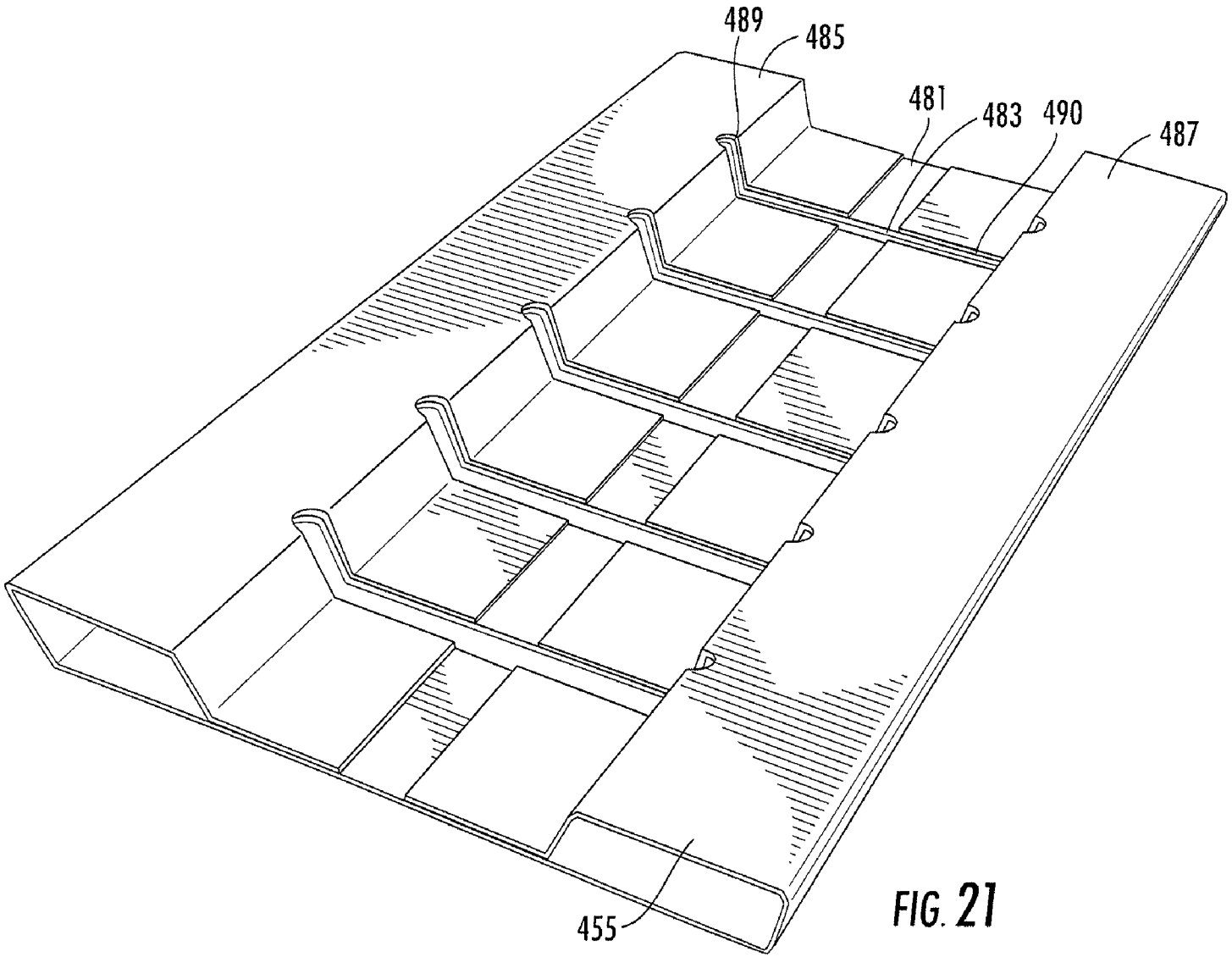
FIG. 21 is a perspective view of the insert of FIG. 20B.

In one embodiment, after forming the display portions 425, each display portion is filled with containers C in a similar manner as the previous embodiments. An insert 455 similar to the inserts 55 of the first embodiment can be placed in each display portion 425 to support the containers C. FIG. 20A illustrates a blank 457 for forming the insert 455 (FIG. 20B). The blank 457 includes a central panel 481 with apertures 483, and two top flaps 485, 487 foldably connected to the central panel. The top flaps 485, 487 have apertures 489, 490. In the assembled insert 455, the top flaps 485, 487 overlay the central panel 481 so that the apertures 489, 490 are aligned with and overlay the apertures 483. The inserts 455 could be omitted from the display portions 425 or the inserts could be otherwise shaped and arranged (e.g., to hold more or less than 6 containers C) without departing from the disclosure.

After loading the display portions 425 with containers C, each display portion may be covered with a hood 461 (FIG. 25) and shipped to the point-of-sale vendor. The two display portions 425 can be hingedly connected and repositioned to form the closed carton 405 when shipped or the display portions can be completely separated when shipped. The point-of-sale vendor removes the hood 461 and positions the display portions in a refrigerated display case or other location for display to customers.

Figure 22:
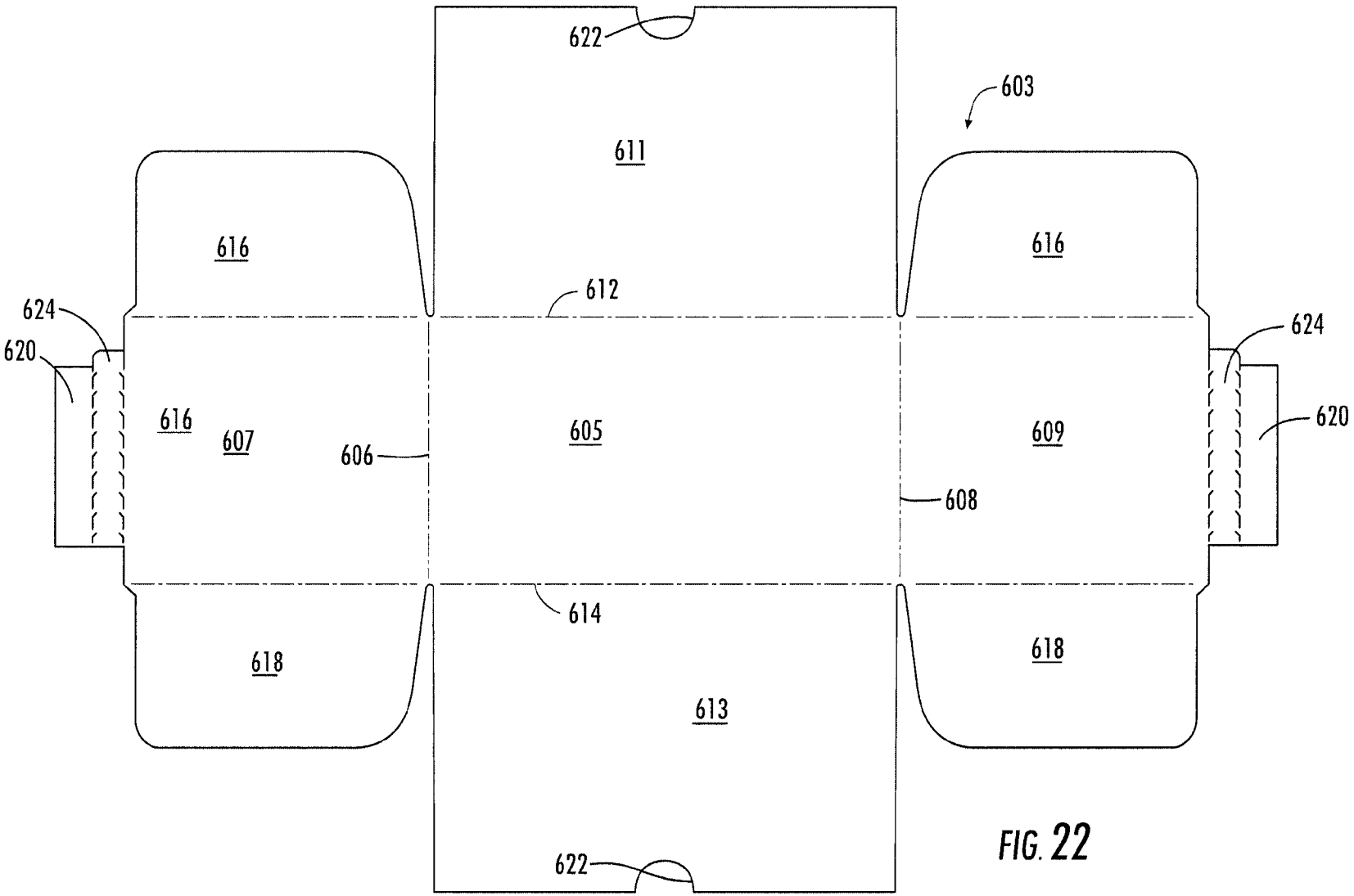
FIG. 22 is a plan view of an exterior surface of a blank used to form a hood used in various embodiments of the shipping and dispensing carton.

FIG. 22 illustrates a blank 603 used to form the hood 461 (FIG. 23A) for covering the carton 405. In the illustrated embodiment, the blank 603 comprises a central panel 605 and two end panels 607, 609 respectively foldably connected to opposite ends of the central panel at respective lateral fold lines 606, 608. The blank 603 has two side panels 611, 613 respectively foldably connected to opposite sides of the central panel at respective longitudinal fold lines 612, 614. Each end panel 607, 609 has respective first and second end flaps 616, 618 attached to each end panel at a respective longitudinal fold line 612, 614. A removable tab 620 of the blank 603 is removably attached to each end panel 607, 609 at a respective tear strip 624. Each side panel 611, 613 has a respective notch 622 at an outer lateral edge of the blank 603.

Figure 23B:
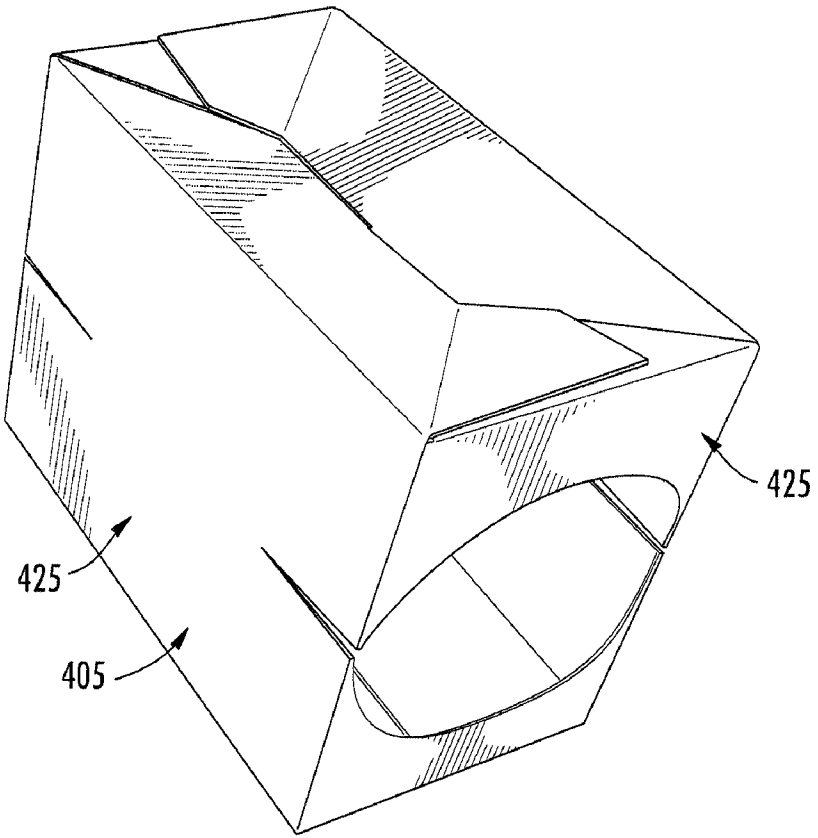
FIG. 23B is a top perspective view of the carton formed from the blank of FIG. 13.
Figure 23A:
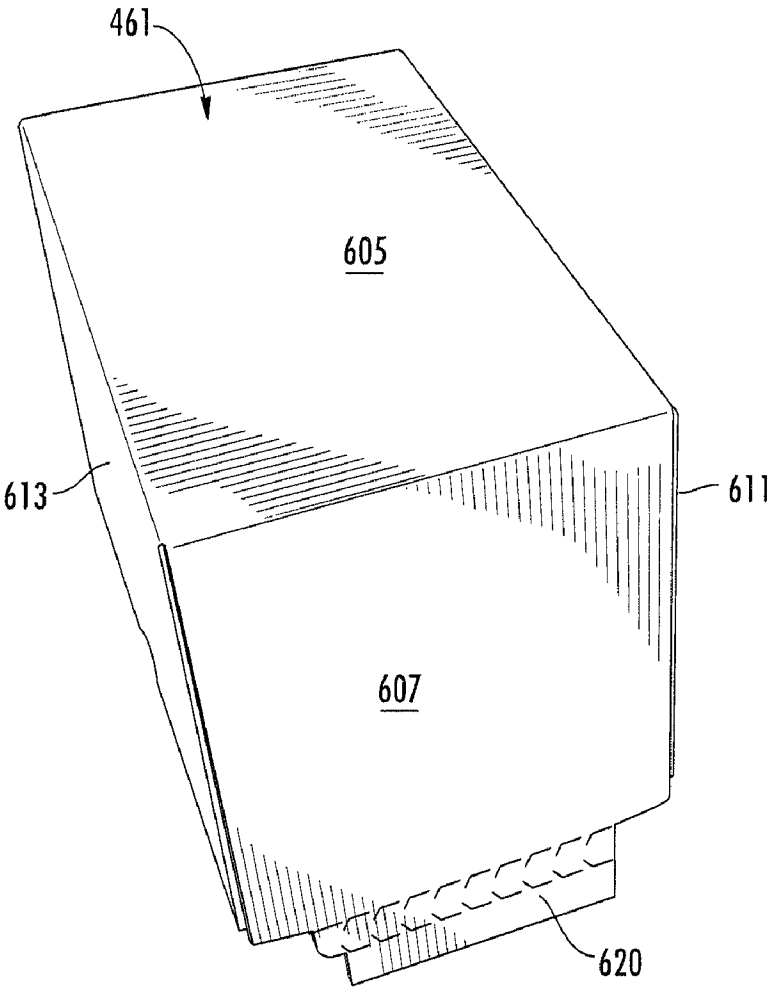
FIG. 23A is a perspective view of the hood formed from the blank of FIG. 22.
Figure 24B:
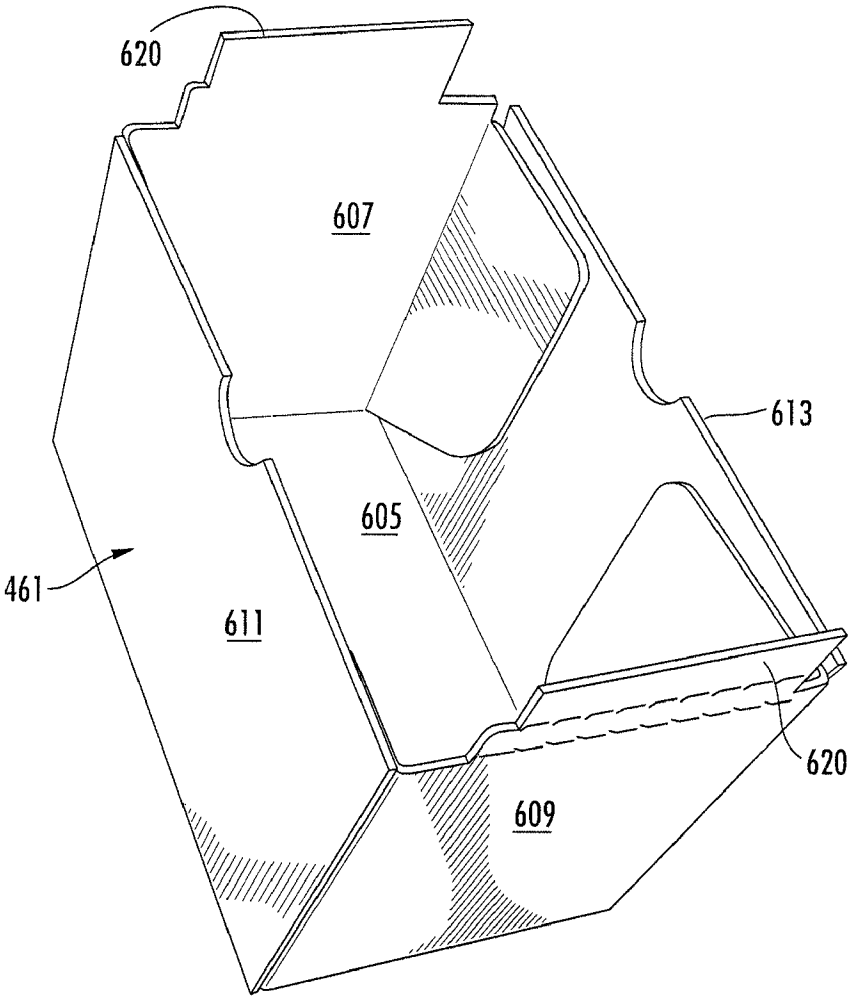
FIG. 24B is a bottom perspective view of the hood of FIG. 23A.
Figure 24A:
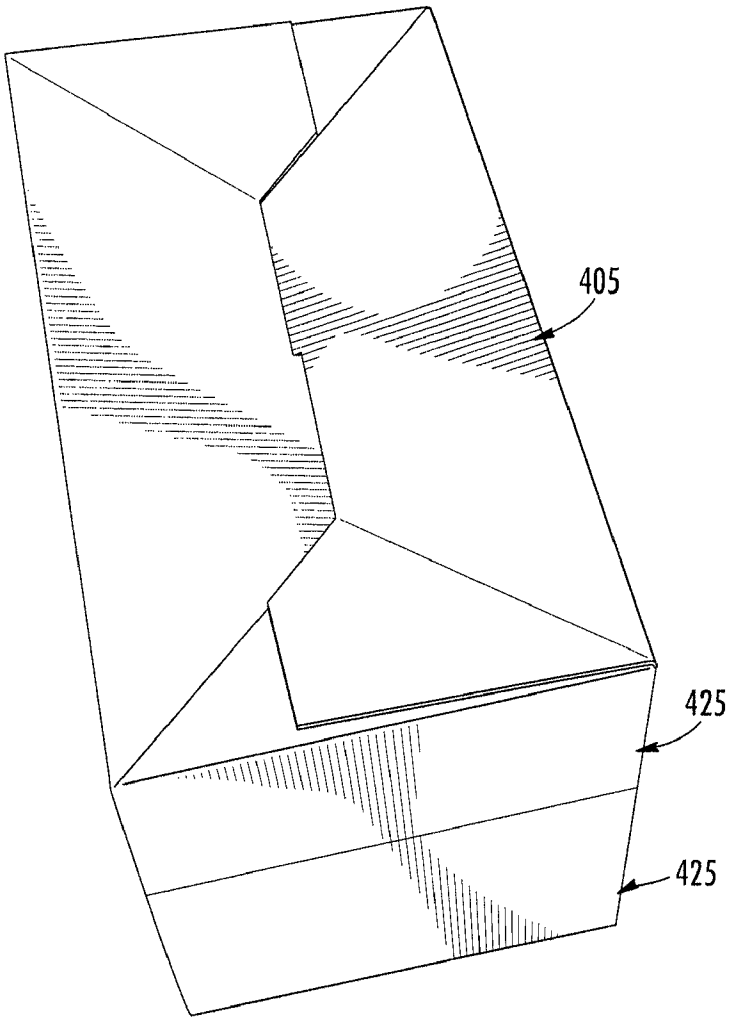
FIG. 24A is a bottom perspective view of the carton of FIG. 23B.
Figure 25:
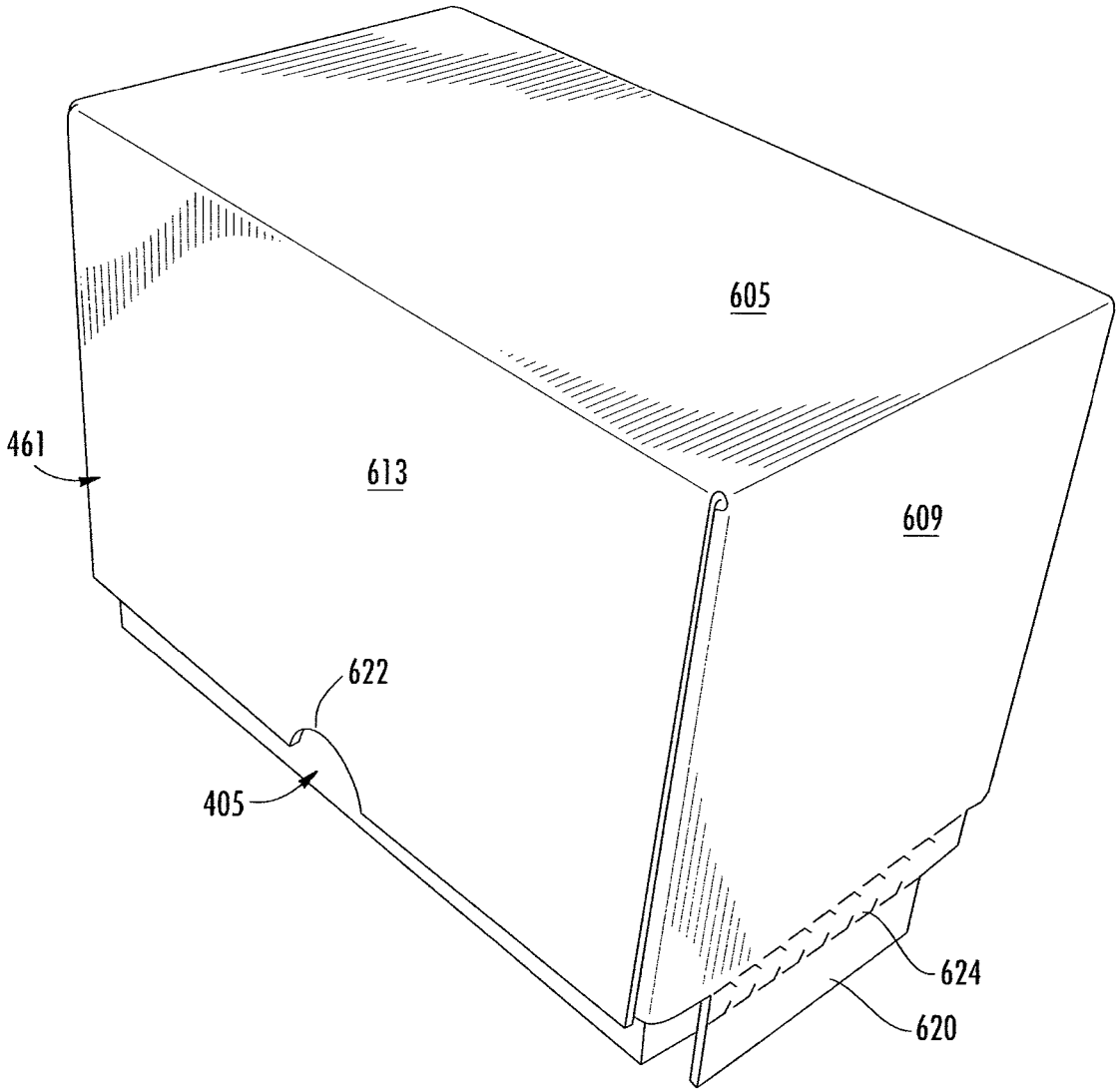
FIG. 25 is a perspective view of the carton of FIG. 23B and the hood of FIG. 23A assembled in a shipping position.
Figure 26:
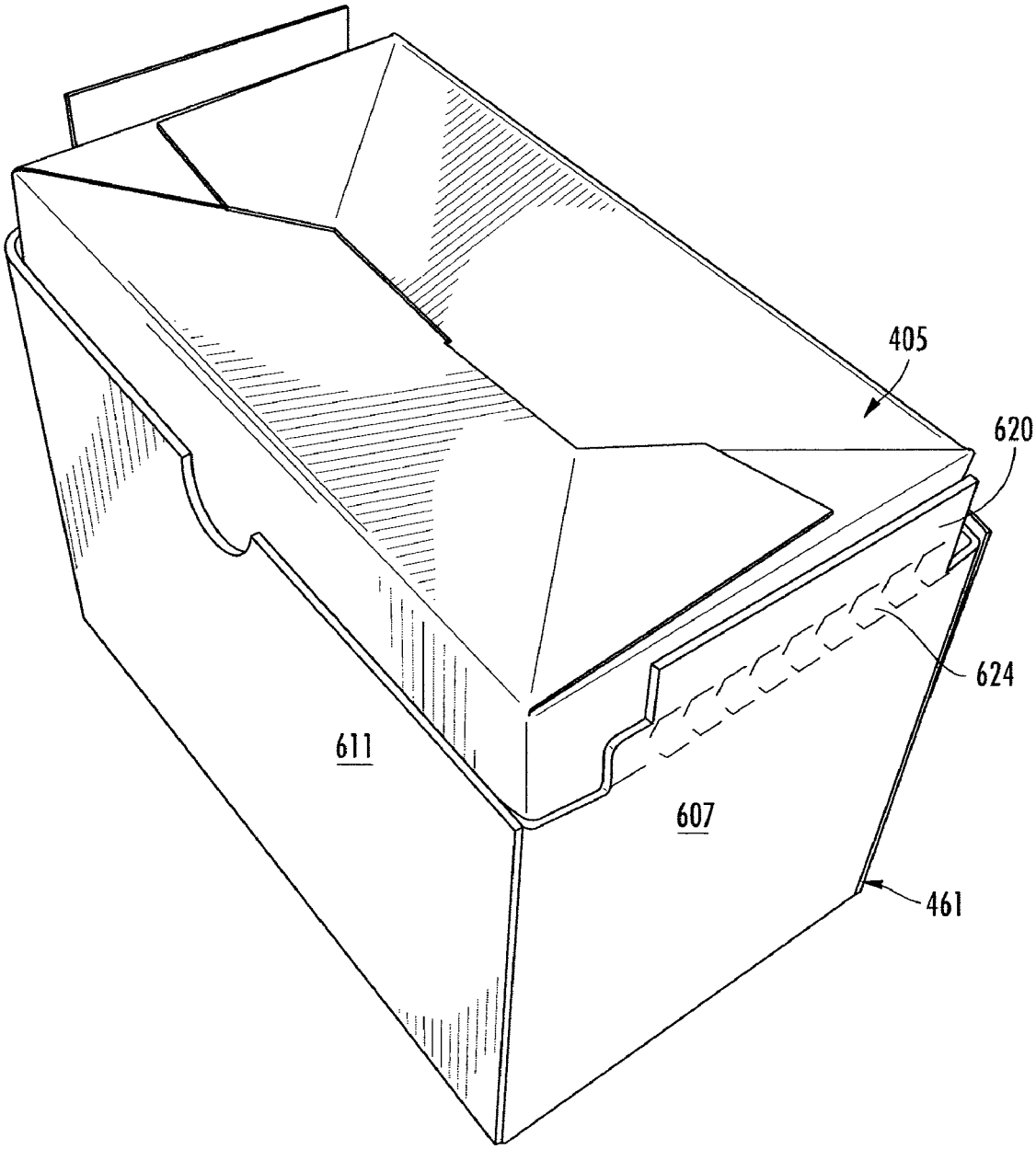
FIG. 26 is a bottom perspective view of the carton and hood of FIG. 25.

FIGS. 23A and 24B respectively illustrate the blank 603 formed into the hood 461. FIGS. 23B and 24A illustrate the carton 405 arranged with one dispensing portion 425 positioned on top of the other dispensing portion. At this point in the assembly process, the carton 405 will have been packed with containers C in the manner described above or by any other suitable manner. As shown in FIGS. 25 and 26, the hood 461 is placed over the assembled and loaded carton 405 to protect the carton and the containers C during shipping to the point-of-sale vendor. The hood 461 can be secured to the carton 405 by folding each of the removable tabs 620 and placing a respective removable tab in face-to-face contact with one of the side panels 420, 430. The removable tabs 620 can be secured to a respective one of the side panels 420, 430 by suitable adhesive (e.g., glue). The hood 461 can be separated from the carton 405 by tearing the tear strip 624 to separate the removable tabs 620 from the remaining portion of the hood 461. The hood 461 can be discarded after removal, and the carton 405 can be converted to the dispensing carton having display portions 425. The hood 461 and/or the carton 405 could be otherwise shaped and/or arranged without departing from the disclosure. Further, the hood 461 could be omitted without departing from the disclosure.

Figure 27:
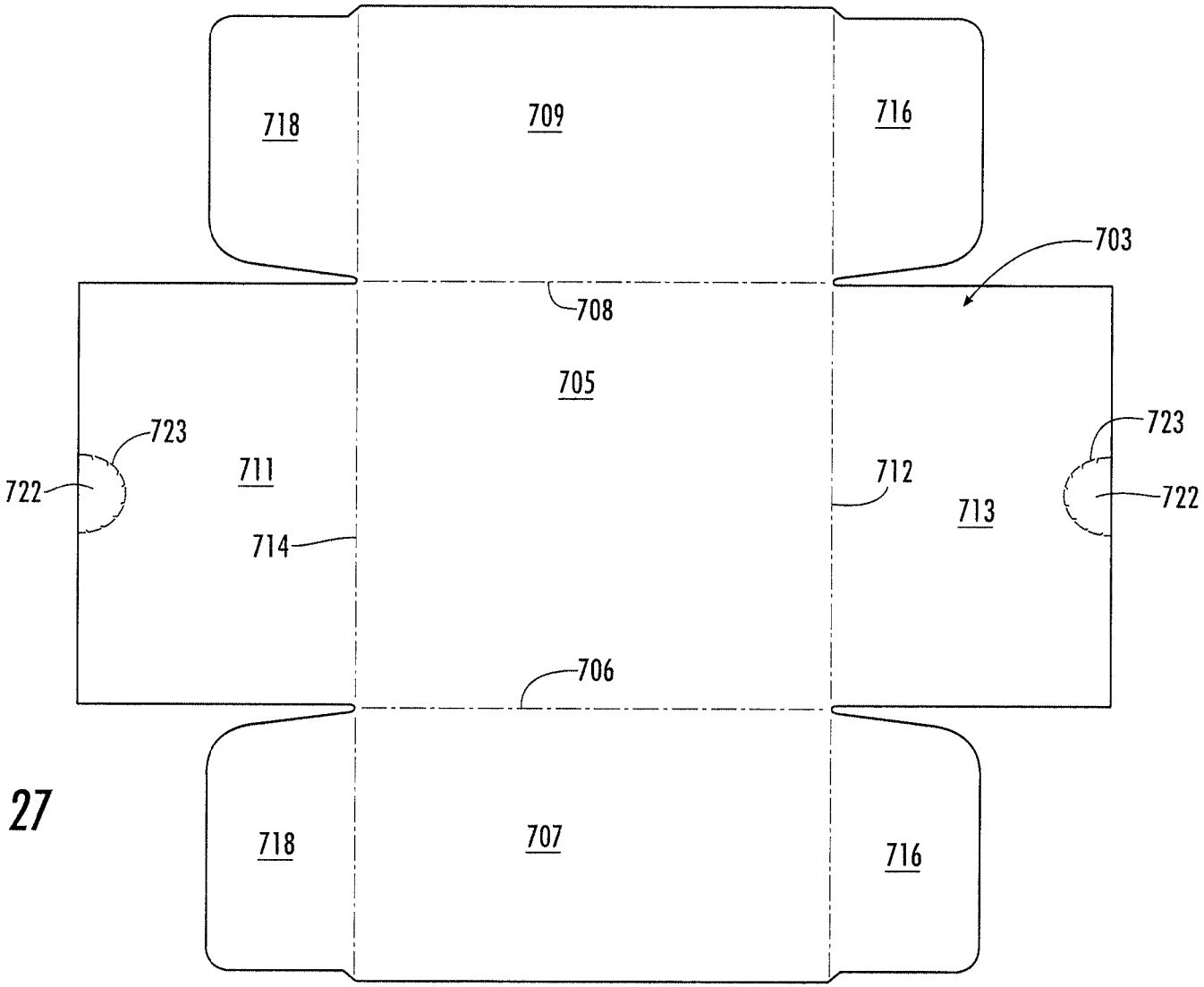
FIG. 27 is an alternative embodiment of a blank for forming a hood.
Figures 28A, 28B:
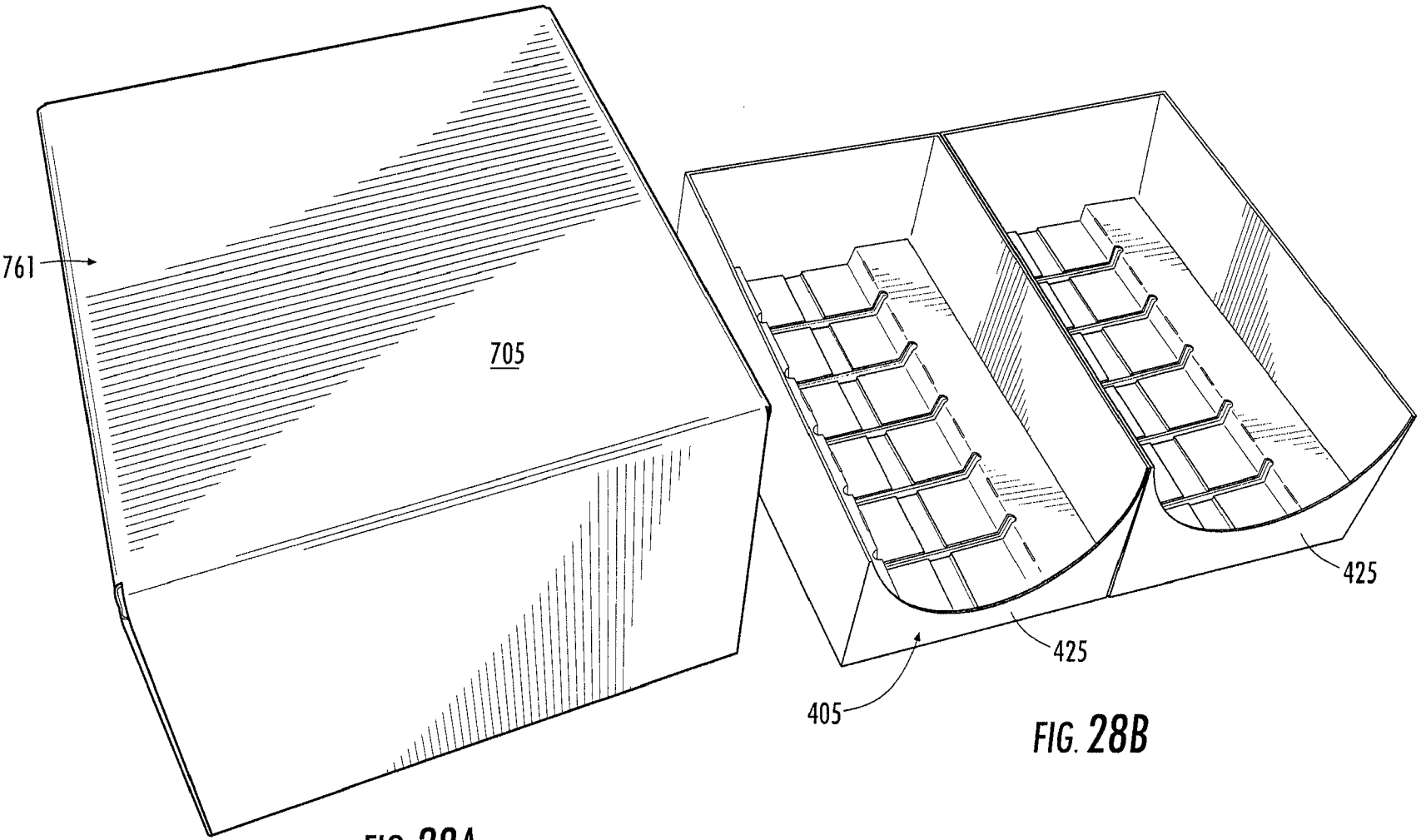
FIG. 28A is a perspective view of the hood formed from the blank of FIG. 27.
FIG. 28B is a perspective view of the carton formed form the blank of FIG. 13 assembled for use with the hood of FIG. 28A.
Figure 29:
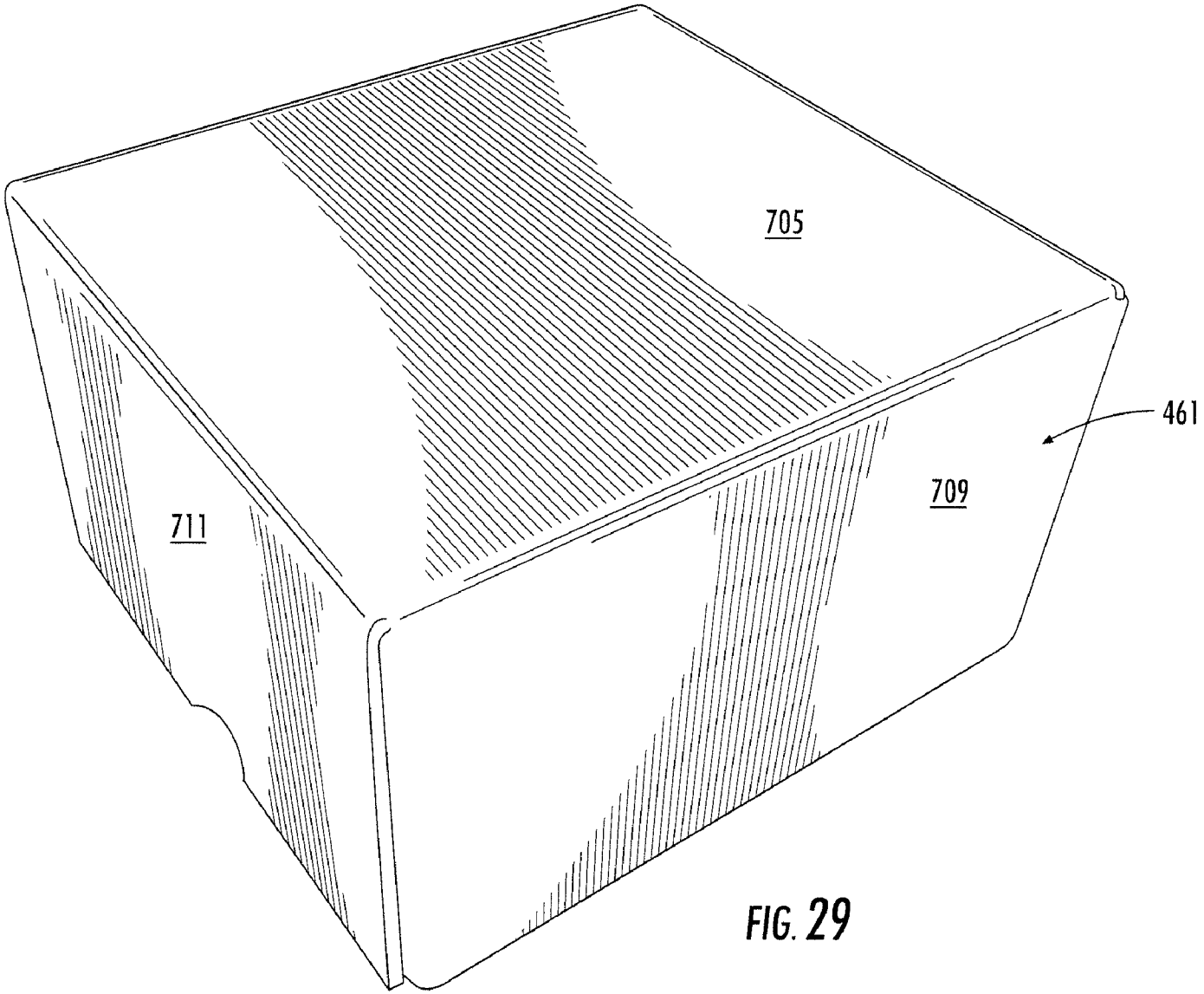
FIG. 29 is a perspective view of the carton of FIG. 28B with the hood of FIG. 28A assembled in a shipping position.

FIG. 27 illustrates a blank 703 used to form an alternate embodiment of a hood 761 (FIG. 28A) of the present disclosure. The blank 703 is generally similar to the blank 603 of the previous embodiment and similar or like reference numbers have been used to indicate corresponding similar or like features. The blank 703 is sized to form the hood 761 that is shaped to cover the carton 405 with the two display portions 425 positioned in a side-by-side arrangement (FIG. 28B). The blank 703 includes removable finger tabs 722 that are removable at a tear line 723 in respective side panels 711, 713 to form notches at the outer edges of the side panels. FIG. 29 illustrates the hood 761 assembled and positioned over a carton 405 to protect that carton during shipping to a point-of-sale vendor. The hood 761 and/or the carton 405 could be otherwise shaped and/or arranged without departing from the disclosure. Further, the hood 761 could be omitted without departing from the disclosure.

Figure 30:
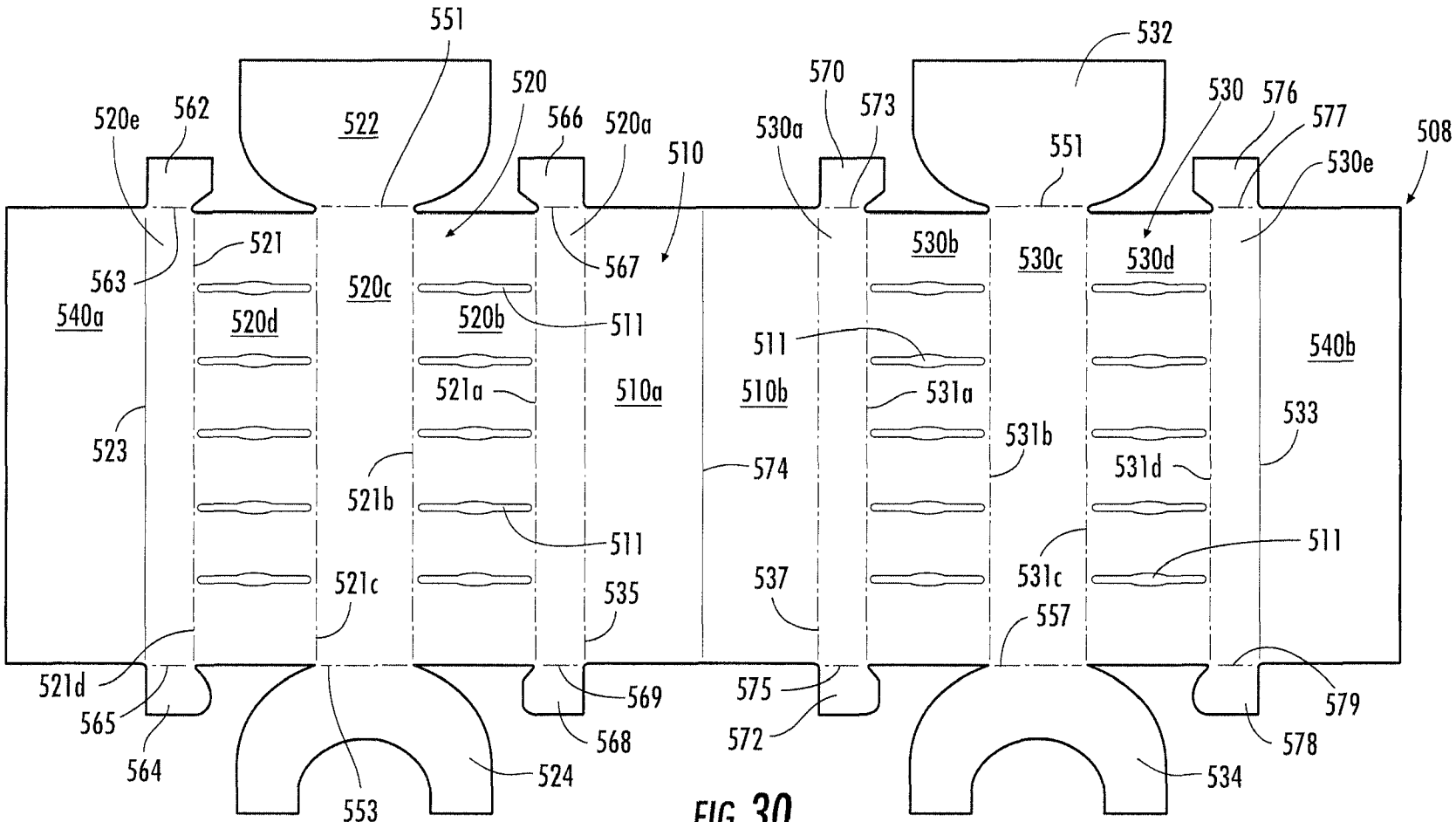
FIG. 30 is a plan view of an exterior surface of a blank for forming a shipping and dispensing carton of a sixth embodiment of the disclosure.
Figure 31:
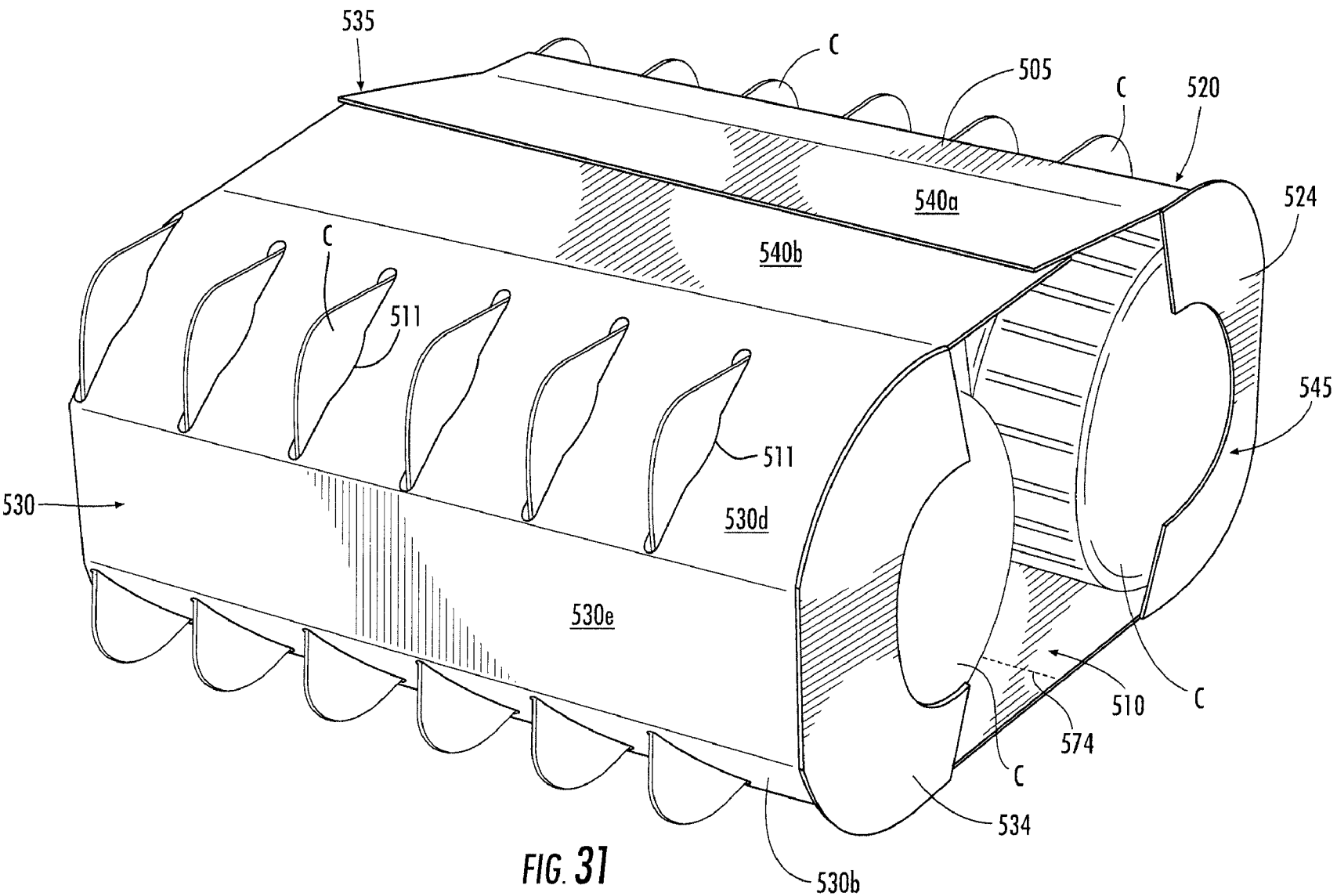
FIG. 31 is a perspective view of the carton formed into the shipping and dispensing container of the sixth embodiment.

FIG. 30 shows a sixth embodiment of the blank 508 for being formed into a carton 505 (FIGS. 29-32) having similar features as the cartons 5, 105, 205, 305, 405 of the previous embodiments. Accordingly, similar or identical features of the embodiments are provided with like reference numbers.

In the sixth embodiment, the blank 508 includes two top panels 540*a*, 540*b*, side panels 520, 530, and bottom panel 510. In the illustrated embodiment each side panel 520, 530 includes five side panel portions 520*a-e*, 530*a-e* that are respectively foldably connected at lateral fold lines 521*a-d*, 531*a-e*. Each of the side panel portions 520*b*, 520*d*, 530*b*, 530*d* has notches 511 (broadly "article retaining features") for receiving portions of the containers C.

The side panel portion 520*c* has side end flaps 522, 524 connected at opposite ends at respective longitudinal fold lines 551, 553. The side panel portion 530*c* has end side flaps 532, 534 connected at opposite ends at respective longitudinal fold lines 555, 557. The side panel portions 520*a*, 5203 have respective side end flaps 562, 564, 566, 568 foldably connected to the side panel portions at respective longitudinal fold lines 563, 565, 567, 569. The side panel portions 530*a*, 530*e* have respective side end flaps 570, 572, 576, 578, foldably connected to the side panel portions at respective longitudinal fold lines 573, 575, 577, 579. The side end flaps 522, 562, 566 and the side end flaps 532, 570, 576 cooperate to at least partially close a respective first end of the carton 505.

The side end flaps 524, 564, 568 and the side end flaps 534, 572, 578 cooperated to at least partially close a respective second end of the carton 505.

In one embodiment, the top panels 540*a*, 540*b* are respectively foldably connected to one of the side panel portions 520*d*, 530*d* at a respective lateral fold line 523, 533. The tear line 574 extends across the bottom panel 510 and divides the bottom panel into a first bottom panel portion 510*a* and a second bottom panel portion 510*b*. The first bottom panel portion 510*a* is foldably connected to the side panel portion 520*a* at a lateral fold line 535. The second bottom panel portion 510*b* is foldably connected to the side panel portion 530*a* at a lateral fold line 537.

In one embodiment, the blank 508 is assembled into the carton 505 (FIG. 31) by generally wrapping the blank around the containers that are received in notches 511 so that the two top panels 540*a*, 540*b* at least partially overlap. The end flaps 522, 532, 562, 566, 570, 576 at least partially close one end 535 of the carton 505 and the end flaps 524, 534, 564, 568, 572, 578 at least partially close the other end 545 of the carton. The carton 505 can be shipped to the point-of-sale vendor in the assembled and loaded state illustrated in FIG. 31.

Figure 32:
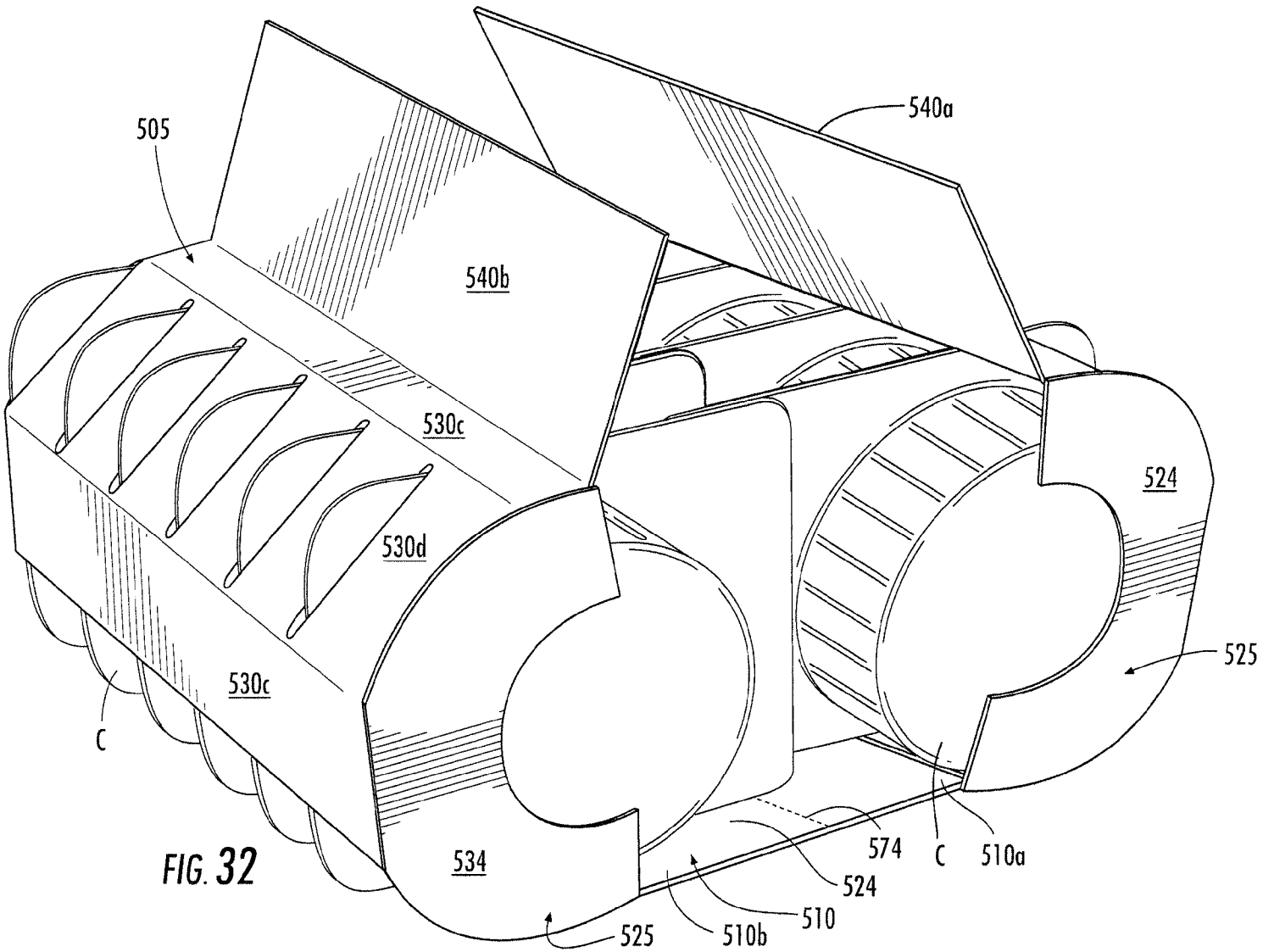
FIGS. 32-34 are various views of the carton of the sixth embodiment in various states of assembly.
Figure 33:
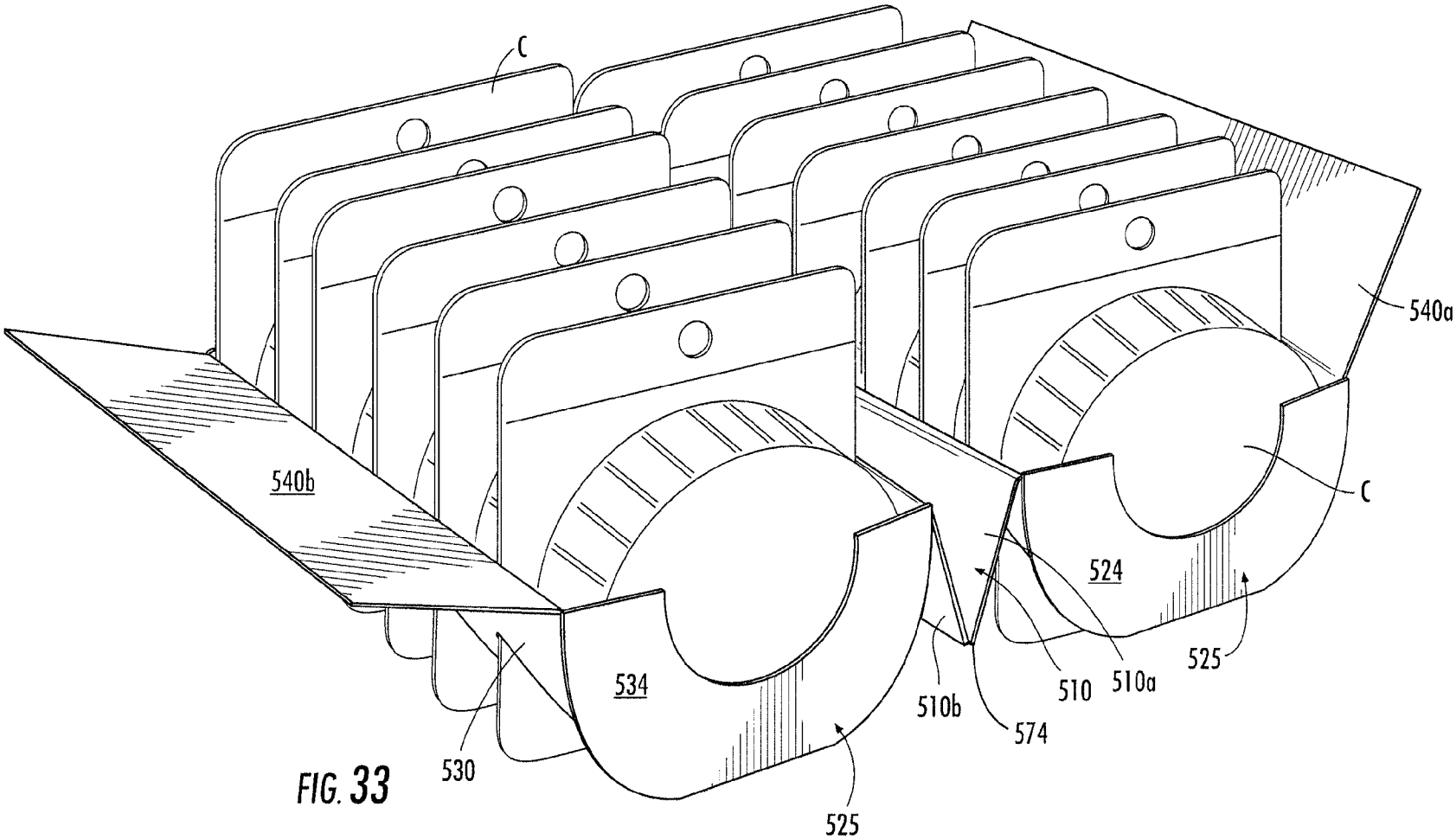
Figure 34:
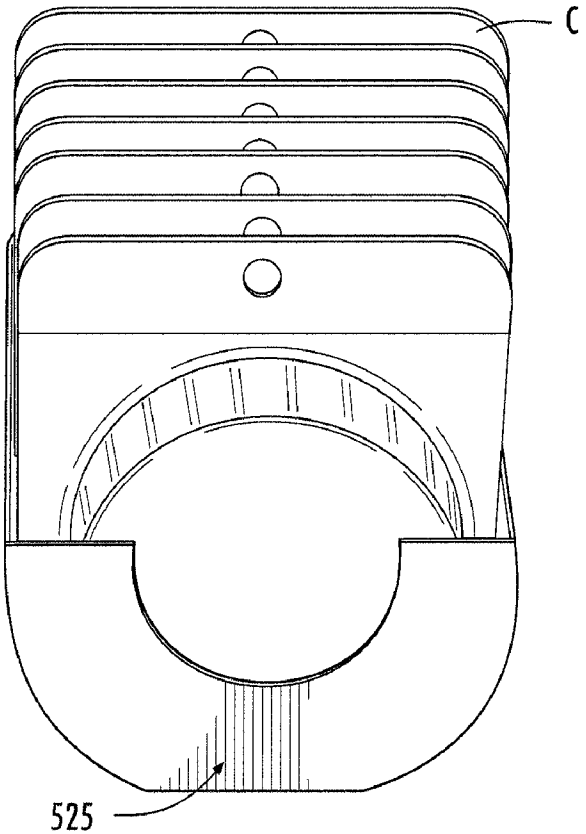
Figure 34:
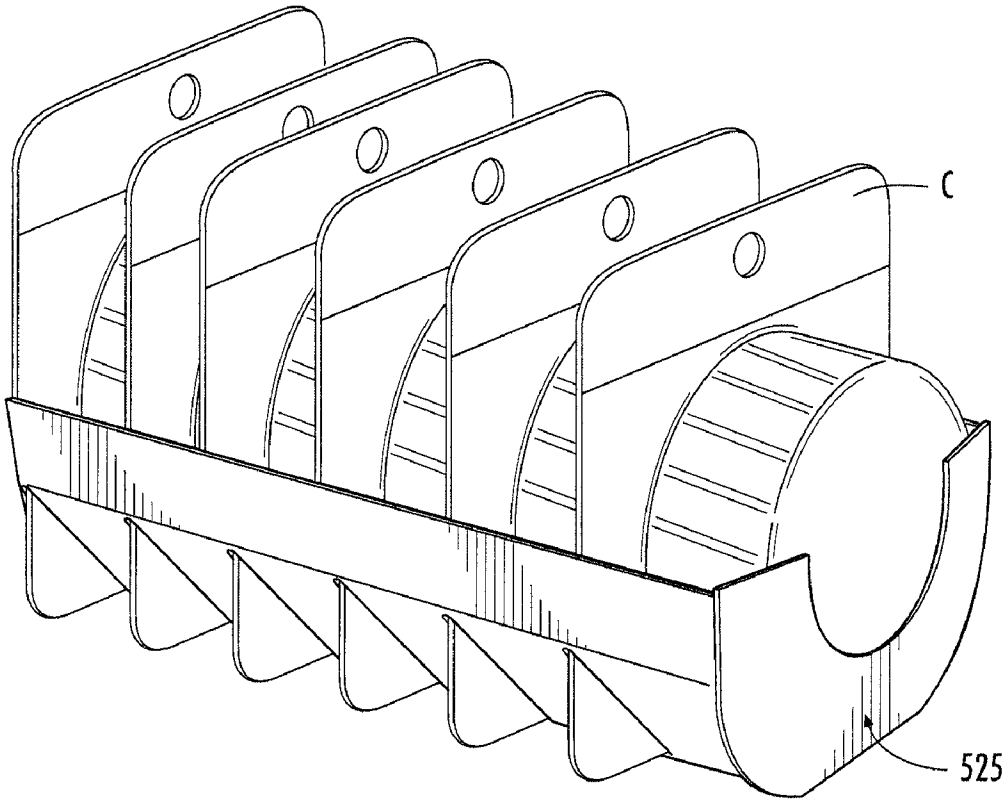

As shown in FIGS. 32-34, the carton 505 is converted from a shipping carton (FIG. 31) to the dispensing carton (FIG. 34) by separating the carton into two dispensing portions 525 by separating the two top panels 540*a*, 540*b* and tearing the bottom panel 510 along tear line 574 to separate the two bottom panel portions 510*a*, 510*b*. The top panels 540*a*, 540*b* and the separated portions 510*a*, 510*b* of the bottom panel 510 can be removed from the side panels 520, 530 by tear along respective fold lines 523, 533, 535, 537, which may be in the form of tear lines. As shown in FIG. 34 The two dispensing portions 525 can by displayed by a point-of-sale vendor in a refrigerated display case or other suitable location In general and for each of the above-discussed blanks, the blank may be constructed from paperboard having a caliper of at least about 13, for example, so that it is heavier and more rigid than ordinary paper. The blank can also be constructed of other materials, such as cardboard, or any other material having properties suitable for enabling the carton to function at least generally as described above.

The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

The above embodiments may be described as having one or panels adhered together by glue. The term "glue" is intended to encompass all manner of adhesives commonly used to secure paperboard carton panels in place, and the adhesive material can be replaced by, or supplemented with any suitable fastening devices.

The term "line" as used herein includes not only straight lines, but also other types of lines such as curved, curvilinear or angularly displaced lines.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, cut line, or the like. For example, a cut line can be a continuous slit or could be wider than a slit without departing from the present disclosure.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A combination shipping and dispensing carton for containing a plurality of articles, the carton comprising:

a plurality of panels that extends at least partially around an interior of the carton, wherein the interior is for containing the plurality of articles, the plurality of panels comprising a first side panel, a second side panel, a bottom panel, and a top panel;

at least two end flaps respectively foldably connected to respective panels of the plurality of panels, wherein the end flaps are overlapped with respect to one another to form a closed end of the carton;

at least one line of separation that at least partially divides the carton into a first portion and a second portion, wherein the first and second portions are configured for being at least partially separated from one another along the line of separation to convert the carton from a shipping carton to at least one dispensing carton in which the first portion is a first dispensing portion for containing a first subset of the articles, and the second portion is a second dispensing portion for containing a second subset of the articles;

the line of separation extending across the entire width of each of the first side panel, the second side panel, the bottom panel, and the top panel and comprising at least one tear line separating the first dispensing portion from the second dispensing portion, wherein the at least one tear line comprises a first portion in the top panel, a second portion in the top panel being spaced apart from the first portion, a third portion in the top panel extending between respective ends of the first portion and the second portion, and fourth portion extending from the third portion to an edge of the top panel; and article retaining features for retaining the plurality of articles.

2. The carton of claim 1 wherein the at least one tear line comprises two spaced-apart tear lines that form an opening section in the carton, the opening section being removed when the carton is converted from a shipping carton to at least one dispensing carton.

3. The carton of claim 2 wherein the opening section comprises at least a portion of each of the top panel and the bottom panel.

4. The carton of claim 3 wherein the opening section comprises at least a portion of each of the first side panel and the second side panel.

5. The carton of claim 2 wherein the fourth portion of the at least one tear line is adjacent the opening section.

6. The carton of claim 4 wherein the end flaps comprises a first top end flap, a second top end flap, and a third top end flap, the third top end flap being for overlapping the first side panel, the opening section comprising at least a portion of the third top end flap.

7. The carton of claim 6 wherein the fourth portion of the at least one tear line extends between a portion of the opening section in the top panel and a portion of the opening section in the third top end flap.

8. The carton of claim 4 wherein each of the spaced-apart tear lines comprises a curved portion in the second side panel.

9. The carton of claim 8 wherein each of the spaced-apart tear lines each comprises an oblique portion in the bottom panel and an oblique portion in the top panel.

10. The carton of claim 4 wherein the opening section comprises an access flap in the top panel.

11. The carton of claim 1 wherein the tear line extends across the bottom panel and separates the bottom panel into two bottom panel portions when the carton is converted to a dispensing carton.

12. The carton of claim 1 wherein the article retaining features comprise inserts that are inserted into the carton for retaining the articles.

13. The carton of claim 12 wherein the inserts include a plurality of notches for receiving a portion of the articles, the inserts comprising a first insert placed in the carton adjacent the first closed end and a second insert placed in the carton adjacent the second closed end.

14. The carton of claim 1 wherein the at least two end flaps comprise a first plurality of end flaps respectively foldably connected to respective panels of the plurality of panels for being at least partially overlapped to close a first end of the carton;

a second plurality of end flaps respectively foldably connected to respective panels of the plurality of panels for being at least partially overlapped to close a second end of the carton;

the first plurality of end flaps comprising a first top end flap foldably connected to the top panel;

the second plurality of end flaps comprising a second top end flap foldably connected to the top panel; and a third top end flap foldably connected to the top panel, the third top end flap being in an overlapping relationship with the first side panel; and the carton comprises an opening section at least partially defined by the at least one tear line in the carton, the opening section being for forming a dispensing opening when the carton is converted from a shipping carton to a dispensing carton, the opening section comprising at least a portion of at least one of the first top end flap, the second top end flap, and the third top end flap.

15. A blank for forming a combination shipping and dispensing carton for containing a plurality of articles, the blank comprising:

a plurality of panels comprising a first side panel, a second side panel, a bottom panel, and a top panel;

at least two end flaps respectively foldably connected to respective panels of the plurality of panels at one end of the blank;

at least one line of separation that at least partially divides the blank into a first portion and a second portion, wherein the first and second portions are configured for being separated from one another along the line of separation to convert the carton erected from the blank from a shipping carton to at least one dispensing carton in which the first portion is a first dispensing portion for containing a first subset of the articles, and the second portion is a second dispensing portion for containing a second subset of the articles;

the line of separation extending across the entire width of each of the first side panel, the second side panel, the bottom panel, and the top panel and comprising at least one tear line for separating the first dispensing portion from the second dispensing portion, wherein the at least one tear line comprises a first portion in the top panel, a second portion in the top panel being spaced apart from the first portion, a third portion in the top panel extending between respective ends of the first portion and the second portion, and fourth portion extending from the third portion to an edge of the top panel; and article retaining features for retaining the plurality of articles.

16. The blank of claim 15 wherein the tear line extends across the bottom panel and separates the bottom panel into two bottom panel portions.

17. The blank of claim 15 wherein the at least two end flaps comprise a first plurality of end flaps respectively foldably connected to respective panels of the plurality of panels at a first end of the blank;

a second plurality of end flaps respectively foldably connected to respective panels of the plurality of panels at a second end of the blank;

the first plurality of end flaps comprising a first top end flap foldably connected to the top panel;

the second plurality of end flaps comprising a second top end flap foldably connected to the top panel; and a third top end flap foldably connected to the top panel, the third top end flap being adapted for being placed in an overlapping relationship with the first side panel when the carton is formed from the blank; and the blank comprises an opening section at least partially defined by the at least one tear line in the blank, the opening section being for forming a dispensing opening when the carton formed from the blank is converted from a shipping carton to a dispensing carton, the opening section comprising at least a portion of at least one of the first top end flap, the second top end flap, and the third top end flap.

18. A method of enclosing and displaying a plurality of articles, comprising:

providing a carton, the carton comprising a plurality of panels comprising a first side panel, a second side panel, a bottom panel, and a top panel, at least two end flaps respectively foldably connected to respective panels of the plurality of panels, at least one line of separation extending across the entire width of each of the first side panel, the second side panel, the bottom panel, and the top panel and comprising at least one tear line that divides the carton into a first dispensing portion and a second dispensing portion, wherein the at least one tear line comprises a first portion in the top panel, a second portion in the top panel being spaced apart from the first portion, a third portion in the top panel extending between respective ends of the first portion and the second portion, and a fourth portion extending from the third portion to an edge of the top panel, and article retaining features for retaining the plurality of articles; and enclosing a plurality of articles in the first dispensing portion and the second dispensing portion comprising positioning the articles in the carton so that the articles are retained by the article retaining features;

providing access to at least some of the plurality of articles, the providing of the access comprising separating the first and second dispensing portions of the carton from one another along the line of separation so that the first dispensing portion contains a first subset of articles and the second dispensing portion contains a second subset of articles.

19. The method of claim 18 wherein the at least one tear line comprises two spaced-apart tear lines that form an opening section of the carton, the providing access comprising removing the opening section to convert the carton from a shipping carton to at least one dispensing carton.

20. The method of claim 19 wherein the opening section comprises at least a portion of each of the top panel and the bottom panel.

21. The method of claim 20 wherein the opening section comprises at least a portion of each of the first side panel and the second side panel.

22. The method of claim 21 wherein the end flaps comprises a first top end flap, a second top end flap, and a third top end flap, the enclosing the plurality of articles comprises overlapping the third top end flap with the first side panel, the opening section comprising at least a portion of the third top end flap.

23. The method of claim 22 wherein the fourth portion of the at least one tear line extends between a portion of the opening section in the top panel and a portion of the opening section in the third top end flap.

24. The method of claim 18 wherein the tear line extends across the bottom panel and the providing access comprises separating the bottom panel into two bottom panel portions and converting the shipping carton to a dispensing carton.

25. The method of claim 18 further comprising obtaining a first insert and a second insert, placing the first insert in the carton adjacent the first closed end, placing the second insert in the carton adjacent the second closed end, the first and second inserts having notches for receiving a portion of the articles.

26. The method of claim 25 further comprising obtaining a hood, placing the hood over the carton to protect the articles and the carton during shipping.

27. The method of claim 26 wherein the hood is placed over the carton after the separating of the first and second dispensing portions of the carton.

* * * * *